US010765291B2

(12) United States Patent
Digman et al.

(10) Patent No.: US 10,765,291 B2
(45) Date of Patent: Sep. 8, 2020

(54) DISHWASHER WITH CHECK VALVE IN ROTATABLE DOCKING PORT

(71) Applicant: Midea Group Co., Ltd., Beijiao, Shunde, Foshan (CN)

(72) Inventors: Robert M. Digman, Goshen, KY (US); Joel Boyer, Louisville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 100 days.

(21) Appl. No.: 16/132,114

(22) Filed: Sep. 14, 2018

(65) Prior Publication Data

US 2020/0085278 A1 Mar. 19, 2020

(51) Int. Cl.
*A47L 15/42* (2006.01)
*A47L 15/50* (2006.01)

(52) U.S. Cl.
CPC ..... *A47L 15/428* (2013.01); *A47L 15/4217* (2013.01); *A47L 15/4246* (2013.01); *A47L 15/4282* (2013.01); *A47L 15/504* (2013.01)

(58) Field of Classification Search
CPC ..... A47L 15/428; A47L 15/4217; A47L 15/4246; A47L 15/4282; A47L 15/504
USPC ..... 134/58 D
See application file for complete search history.

(56) References Cited

U.S. PATENT DOCUMENTS 2,734,520 A 2/1956 Abresch
2,808,063 A 10/1957 Abresch et al.
2,907,335 A 10/1959 Abresch
2,939,465 A 6/1960 Kesling
2,956,572 A 10/1960 Levit et al.
2,973,907 A 3/1961 Abresch et al.
2,980,120 A 4/1961 Jacobs
3,006,557 A 10/1961 Jacobs
3,026,046 A 3/1962 Wickham et al.
3,044,842 A 7/1962 Abresch et al.
3,051,183 A 8/1962 Jacobs
3,077,200 A 2/1963 Guth
3,082,779 A 3/1963 Jacobs
3,088,474 A 5/1963 Leslie
3,101,730 A 8/1963 Harris et al.
3,115,306 A 12/1963 Graham
3,178,117 A 4/1965 Hanifan
3,192,935 A 7/1965 Hanifan
3,210,010 A 10/1965 Delapena
3,324,867 A 6/1967 Freese
3,348,775 A 10/1967 Flame
(Continued)

FOREIGN PATENT DOCUMENTS

CN 2094961 U 2/1992
CN 1879547 A 12/2006
(Continued)

OTHER PUBLICATIONS

International Search Report and Written Opinion issued in Application No. PCT/CN2019/097332 dated Dec. 9, 2019.
(Continued)

*Primary Examiner* — Tinsae B Ayalew
(74) *Attorney, Agent, or Firm* — Middleton Reutlinger

(57) ABSTRACT

A dishwasher and method for operating the same utilize a check valve in a rotatable docking port to control the flow of fluid such as wash fluid or pressurized air to a rotatable conduit supported in the rack of a dishwasher.

20 Claims, 16 Drawing Sheets

(56) References Cited

U.S. PATENT DOCUMENTS

| | | | |
|---|---|---|---|
| 3,361,361 | A | 1/1968 | Schutte |
| 3,454,784 | A | 7/1969 | Wantz et al. |
| 3,538,927 | A | 11/1970 | Harald |
| 3,586,011 | A | 6/1971 | Mazza |
| 3,590,688 | A | 7/1971 | Brannon |
| 3,596,834 | A | 8/1971 | Cushing |
| 3,719,323 | A | 3/1973 | Raiser |
| 4,175,575 | A | 11/1979 | Cushing |
| 4,226,490 | A | 10/1980 | Jenkins et al. |
| 4,398,562 | A | 8/1983 | Saarem et al. |
| 4,657,188 | A | 4/1987 | Crane et al. |
| 4,718,440 | A | 1/1988 | Hawker et al. |
| 4,732,323 | A | 3/1988 | Jarvis et al. |
| 5,211,190 | A | 5/1993 | Johnson et al. |
| 5,226,454 | A | 7/1993 | Cabalfin |
| 5,341,827 | A | 8/1994 | Kim |
| 5,697,392 | A | 12/1997 | Johnson et al. |
| 5,725,002 | A | 3/1998 | Payzant |
| 6,053,185 | A | 3/2000 | Cirjak et al. |
| 6,431,188 | B1 | 8/2002 | Laszczewski, Jr. et al. |
| 6,612,009 | B1 | 9/2003 | Laszczewski, Jr. et al. |
| 6,694,990 | B2 | 2/2004 | Spanyer et al. |
| 6,869,029 | B2 | 3/2005 | Ochoa et al. |
| 7,055,537 | B2 | 6/2006 | Elick et al. |
| 7,210,315 | B2 | 5/2007 | Castelli et al. |
| 7,293,435 | B2 | 11/2007 | Elexpuru et al. |
| 7,445,013 | B2 | 11/2008 | VanderRoest et al. |
| 7,464,718 | B2 | 12/2008 | McIntyre et al. |
| 7,556,049 | B2 | 7/2009 | Oakes et al. |
| 7,587,916 | B2 | 9/2009 | Rizzetto |
| 7,594,513 | B2 | 9/2009 | VanderRoest et al. |
| 7,607,325 | B2 | 10/2009 | Elexpuru et al. |
| 7,650,765 | B2 | 1/2010 | Rizzetto |
| 7,914,625 | B2 | 3/2011 | Bertsch et al. |
| 7,935,194 | B2 | 5/2011 | Rolek |
| 8,136,537 | B2 | 3/2012 | Cerrano et al. |
| 8,161,995 | B2 | 4/2012 | Armstrong et al. |
| 8,191,560 | B2 | 6/2012 | Mallory et al. |
| 8,443,765 | B2 | 5/2013 | Hollis |
| 8,696,827 | B2 | 4/2014 | Ashrafzadeh et al. |
| 8,778,094 | B2 | 7/2014 | Blanchard et al. |
| 8,858,729 | B2 | 10/2014 | Buddharaju et al. |
| 8,900,375 | B2 | 12/2014 | Gnadinger et al. |
| 8,915,257 | B2 | 12/2014 | Büsing et al. |
| 8,932,411 | B2 | 1/2015 | Beaudet et al. |
| 8,978,674 | B2 | 3/2015 | Buesing |
| 8,985,128 | B2 | 3/2015 | Pyo et al. |
| 9,121,217 | B1 | 9/2015 | Hoffberg |
| 9,170,584 | B2 | 10/2015 | Lum et al. |
| 9,204,780 | B2 | 12/2015 | Francisco et al. |
| 9,220,393 | B2 | 12/2015 | Becker et al. |
| 9,241,604 | B2 | 1/2016 | Dries |
| 9,259,137 | B2 | 2/2016 | Boyer et al. |
| 9,265,400 | B2 | 2/2016 | Bigott |
| 9,307,888 | B2 | 4/2016 | Baldwin et al. |
| 9,326,657 | B2 | 5/2016 | Thiyagarajan |
| 9,480,389 | B2 | 11/2016 | Haft et al. |
| 9,492,055 | B2 | 11/2016 | Feddema |
| 9,532,700 | B2 | 1/2017 | Welch |
| 9,635,994 | B2 | 5/2017 | Boyer et al. |
| 9,655,496 | B2 | 5/2017 | Baldwin et al. |
| 9,915,356 | B2 | 3/2018 | Chang et al. |
| 9,958,073 | B2 | 5/2018 | Yang |
| 10,524,634 | B2 | 1/2020 | Digman |
| 10,531,781 | B2 | 1/2020 | Digman et al. |
| 2005/0011544 | A1 | 1/2005 | Rosenbauer et al. |
| 2005/0139240 | A1 | 6/2005 | Bong et al. |
| 2005/0241680 | A1 | 11/2005 | Noh |
| 2005/0241681 | A1 | 11/2005 | Hwang |
| 2006/0278258 | A1 | 12/2006 | Kara et al. |
| 2008/0163904 | A1 | 7/2008 | Hwang |
| 2008/0271765 | A1 | 11/2008 | Burrows |
| 2008/0276975 | A1 | 11/2008 | Disch |
| 2009/0071508 | A1 | 3/2009 | Sundaram et al. |
| 2009/0090400 | A1 | 4/2009 | Burrows et al. |
| 2009/0145468 | A1 | 6/2009 | Chericoni |
| 2010/0043826 | A1 | 2/2010 | Bertsch et al. |
| 2011/0186085 | A1 | 8/2011 | Chen et al. |
| 2012/0060875 | A1 | 3/2012 | Fauth et al. |
| 2012/0175431 | A1 | 7/2012 | Althammer et al. |
| 2012/0291827 | A1 | 11/2012 | Buddharaju et al. |
| 2013/0000762 | A1 | 1/2013 | Buddharaju et al. |
| 2013/0319483 | A1 | 12/2013 | Welch |
| 2014/0059880 | A1 | 3/2014 | Bertsch et al. |
| 2014/0069470 | A1 | 3/2014 | Baldwin et al. |
| 2014/0373876 | A1 | 12/2014 | Feddema |
| 2015/0007861 | A1 | 1/2015 | Azmi et al. |
| 2015/0266065 | A1 | 9/2015 | Savoia |
| 2016/0198928 | A1 | 7/2016 | Xu et al. |
| 2017/0181599 | A1 | 6/2017 | Choi et al. |
| 2017/0224190 | A1 | 8/2017 | Sakthivel et al. |
| 2017/0265707 | A1* | 9/2017 | Roderick ..... A47L 15/22 |
| 2017/0273535 | A1 | 9/2017 | Roderick et al. |
| 2017/0354308 | A1 | 12/2017 | Choi et al. |
| 2018/0084967 | A1 | 3/2018 | Ross et al. |
| 2018/0110397 | A1 | 4/2018 | Kim et al. |
| 2018/0132692 | A1 | 5/2018 | Dries et al. |
| 2018/0168425 | A1 | 6/2018 | Wilson et al. |
| 2018/0192851 | A1 | 7/2018 | Gursoy et al. |
| 2018/0333037 | A1 | 11/2018 | Roderick et al. |
| 2019/0059688 | A1 | 2/2019 | Woo et al. |
| 2019/0099054 | A1 | 4/2019 | Digman et al. |
| 2019/0099056 | A1 | 4/2019 | Digman |

FOREIGN PATENT DOCUMENTS

| | | | |
|---|---|---|---|
| CN | 101049224 | A | 10/2007 |
| CN | 101134198 | A | 3/2008 |
| CN | 201067392 | Y | 6/2008 |
| CN | 101795613 | A | 8/2010 |
| CN | 102370450 | A | 3/2012 |
| CN | 102512128 | A | 6/2012 |
| CN | 102940476 | A | 2/2013 |
| CN | 203447254 | U | 2/2014 |
| CN | 203749364 | U | 8/2014 |
| CN | 203763025 | U | 8/2014 |
| CN | 104433985 | A | 3/2015 |
| CN | 104523208 | A | 4/2015 |
| CN | 104757921 | A | 7/2015 |
| CN | 104840165 | A | 8/2015 |
| CN | 204671085 | U | 9/2015 |
| CN | 105147218 | A | 12/2015 |
| CN | 105231971 | A | 1/2016 |
| CN | 205094364 | U | 3/2016 |
| CN | 105286746 | B | 2/2018 |
| DE | 3537184 | A1 | 4/1987 |
| DE | 10121083 | A1 | 10/2002 |
| DE | 10300501 | A1 | 7/2004 |
| DE | 202004013786 | U1 | 12/2004 |
| DE | 102008011743 | A1 | 9/2009 |
| DE | 202014010365 | U1 | 5/2015 |
| EP | 0559466 | A1 | 9/1993 |
| EP | 0679365 | A1 | 11/1995 |
| EP | 0764421 | A1 | 3/1997 |
| EP | 0786231 | A2 | 7/1997 |
| EP | 0864291 | A1 | 9/1998 |
| EP | 1132038 | A2 | 9/2001 |
| EP | 1136030 | A1 | 9/2001 |
| EP | 1238622 | A2 | 9/2002 |
| EP | 1252856 | A2 | 10/2002 |
| EP | 1632166 | A2 | 3/2006 |
| EP | 1758494 | A1 | 3/2007 |
| EP | 2636786 | A1 | 9/2013 |
| EP | 2059160 | B1 | 3/2015 |
| FR | 1473796 | A | 3/1967 |
| GB | 572623 | A | 10/1945 |
| GB | 2244209 | A | 11/1991 |
| JP | 2003339607 | A | 12/2003 |
| JP | 2014121353 | A | 7/2014 |
| KR | 100786069 | B1 | 12/2007 |
| KR | 101173691 | B1 | 8/2012 |
| KR | 200464747 | Y1 | 1/2013 |
| WO | WO2009008827 | A1 | 1/2009 |
| WO | 2016008699 | A1 | 1/2016 |

(56) References Cited

FOREIGN PATENT DOCUMENTS

| | | | |
|---|---|---|---|
| WO | 2017022974 | A1 | 2/2017 |
| WO | 2018053635 | A1 | 3/2018 |
| WO | 2018107833 | A1 | 6/2018 |
| WO | 2018107834 | A1 | 6/2018 |
| WO | 2018107835 | A1 | 6/2018 |

OTHER PUBLICATIONS

International Search Report and Written Opinion issued in Application No. PCT/CN2019/079236 dated Jun. 25, 2019.
International Search Report and Written Opinion issued in Application No. PCT/CN2019/078611 dated Jun. 5, 2019.
Electrolux Home Products, Inc. "Dishwasher Use & Care Guide 1500 Series with Fully Electronic Control" 2003.
SCRIBD, Sears Kenmore Elite 2013 Stainless Steel Tall Tub Dishwasher Service Manual, www.scribd.com, Retrieved on Dec. 5, 2018.
EVERYSPEC, Federal Specification: Dishwashing Machines, Single Tank and Double Tank, Commercial, www.everyspec.com, Oct. 17, 1983.
Transmittal of Related Applications dated Apr. 30, 2019.
Transmittal of Related Applications dated Sep. 17, 2018.
U.S. Patent and Trademark Office, Office Action issued in related U.S. Appl. No. 15/721,091 dated May 23, 2019.
International Search Report and Written Opinion issued in Application No. PCT/CN2019/078799 dated Jun. 26, 2019.
International Search Report and Written Opinion issued in Application No. PCT/CN2019/078612 dated Jun. 28, 2019.
U.S. Patent Office; Non-Final Office Action issued in U.S. Appl. No. 15/721,099 dated Jul. 30, 2019.
DE10121083A1 machine translation (Year: 2002).
International Search Report and Written Opinion issued in Application No. PCT/CN2018/074294 dated Jul. 5, 2018.
International Search Report and Written Opinion issued in Application No. PCT/CN2018/074268 dated Jul. 13, 2018.
U.S. Patent and Trademark Office, Office Action issued in related U.S. Appl. No. 15/721,091 dated Oct. 11, 2019.
U.S. Patent Office; Notice of Allowance issued in U.S. Appl. No. 15/721,091 dated Oct. 23, 2019.
U.S. Patent and Trademark Office, Office Action issued in related U.S. Appl. No. 15/721,099 dated Nov. 4, 2019.
U.S. Patent Office; Notice of Allowance issued in U.S. Appl. No. 15/721,099 dated Nov. 18, 2019.
U.S. Patent and Trademark Office, Notice of Allowance issued in U.S. Appl. No. 16/132,091 dated Mar. 18, 2020.

* cited by examiner

DISHWASHER WITH CHECK VALVE IN ROTATABLE DOCKING PORT

BACKGROUND

Dishwashers are used in many single-family and multi-family residential applications to clean dishes, silverware, cutlery, cups, glasses, pots, pans, etc. (collectively referred to herein as "utensils"). Many dishwashers rely primarily on rotatable spray arms that are disposed at the bottom and/or top of a tub and/or are mounted to a rack that holds utensils. A spray arm is coupled to a source of wash fluid and includes multiple apertures for spraying wash fluid onto utensils, and generally rotates about a central hub such that each aperture follows a circular path throughout the rotation of the spray arm. The apertures may also be angled such that force of the wash fluid exiting the spray arm causes the spray arm to rotate about the central hub.

While traditional spray arm systems are simple and mostly effective, they have the short coming of that they must spread the wash fluid over all areas equally to achieve a satisfactory result. In doing so resources such as time, energy and water are generally wasted because wash fluid cannot be focused precisely where it is needed. Moreover, because spray arms follow a generally circular path, the corners of a tub may not be covered as thoroughly, leading to lower cleaning performance for utensils located in the corners of a rack. In addition, in some instances the spray jets of a spray arm may be directed to the sides of a wash tub during at least portions of the rotation, leading to unneeded noise during a wash cycle.

SUMMARY

The herein-described embodiments address these and other problems associated with the art by providing a dishwasher and method for operating the same utilizing a check valve in a rotatable docking port to control the flow of fluid such as wash fluid or pressurized air to a rotatable conduit supported in the rack of a dishwasher.

Therefore, consistent with one aspect of the invention, a dishwasher may include a wash tub, a rack supported in the wash tub and movable between loading and washing positions, a rotatable conduit supported by the rack for movement with the rack, the conduit having a connector for receiving wash fluid, and a docking arrangement coupled to a rear wall of the wash tub and configured to engage with the connector of the conduit when the rack is in the washing position to supply wash fluid to the conduit. The docking arrangement includes a rotatable docking port positioned to receive the connector of the conduit along an axis of insertion when the rack is moved from the loading position to the washing position, the rotatable docking port being rotatable about an axis of rotation and configured to engage the connector of the conduit such that the conduit rotates with rotation of the rotatable docking port about the axis of rotation, and a check value coupled to and rotatable with the rotatable docking port, the check valve movable between opened and closed positions and biased to the closed position when the connector of the conduit is disengaged from the rotatable docking port.

Moreover, in some embodiments, the check valve is movable generally axially along the axis of insertion from the closed to the opened position in response to engagement of the connector of the conduit with the rotatable docking port. In some embodiments, the check valve includes a cup-shaped diaphragm having a generally cylindrical sidewall, the rotatable docking port includes a radially-facing inlet configured to receive fluid, and the sidewall of the cup-shaped diaphragm blocks the radially-facing inlet when the check valve is in the closed position. Further, in some embodiments, the check valve further includes an end surface and an annular sealing flange joined by the generally cylindrical sidewall. Also, in some embodiments, the check valve further includes an annular mounting flange extending generally transversely to the annular sealing flange and configured to mount the check valve to a valve body of the rotatable docking port. Further, in some embodiments, at least one of the annular mounting flange and the end surface is relatively stiffer than the generally cylindrical sidewall. Also, in some embodiments, the generally cylindrical sidewall and the annular sealing flange are formed of a low durometer material, and each of the annular mounting flange and the end surface includes a rigid material overmolded with the low durometer material.

In addition, in some embodiments, the check valve includes a flap secured along one edge thereof to the rotatable docking port. Moreover, in some embodiments, the check valve includes a biasing member configured to bias the check valve in the closed position. In some embodiments, the biasing member includes a fin extending generally transverse to the flap. Further, in some embodiments, the fin is bendable and integrally formed with the flap. In some embodiments, the flap and the fin are formed of a low durometer material.

Moreover, in some embodiments, the rotatable docking port includes a fluid inlet configured to receive fluid, and the dishwasher further includes a valve member disposed at a predetermined rotational position about the axis of rotation to restrict fluid flow to the conduit when the fluid inlet is rotated to the predetermined rotational position.

Further, in some embodiments, the fluid inlet is a radially-facing inlet, the rotatable docking port includes a valve body having a substantially cylindrical sidewall, the fluid inlet is disposed in the substantially cylindrical sidewall of the valve body, and the valve member includes a mating surface facing the valve body and being substantially arcuate in cross-section.

In some embodiments, the rack is adjustable between first and second elevations within the wash tub, the rotatable docking port is a first rotatable docking port positioned to receive the connector of the conduit when the rack is adjusted to the first elevation and disposed in the washing position, and the docking arrangement further includes a second rotatable docking port positioned to receive the connector of the conduit when the rack is adjusted to the second elevation and disposed in the washing position, the second rotatable docking port including a second check value coupled to and rotatable with the second rotatable docking port, the second check valve movable between opened and closed positions and biased to the closed position when the connector of the conduit is disengaged from the second rotatable docking port.

Also, in some embodiments, the conduit includes a tubular spray element being rotatable about a longitudinal axis thereof, the tubular spray element includes one or more apertures extending through an exterior surface thereof, and the dishwasher further includes a tubular spray element drive coupled to the rotatable docking port to rotate the rotatable docking port to discretely direct the tubular spray element to each of a plurality of rotational positions about the longitudinal axis thereof.

Moreover, in some embodiments, the tubular spray element drive includes an electric motor, the electric motor includes a first gear coupled to a drive shaft thereof, and the rotatable docking port includes a second gear that engages the first gear such that rotation of the first gear by the electric motor rotates the rotatable docking port.

In addition, in some embodiments, the tubular spray element is a first tubular spray element, the rotatable docking port is a first rotatable docking port, the tubular spray element drive is a first tubular spray element drive, the dishwasher further includes a second tubular spray element rotatably supported by the rack, the docking arrangement includes a manifold, and the docking arrangement further includes a second rotatable docking port positioned to receive a connector of the second tubular spray element when the rack is moved from the loading position to the washing position, the second rotatable docking port being rotatable about a second axis of rotation, the second rotatable docking port further configured to engage the connector of the second tubular spray element such that the second tubular spray element rotates about the second axis of rotation along with rotation of the second rotatable docking port, a second tubular spray element drive coupled to the second rotatable docking port to rotate the second rotatable docking port to discretely direct the second tubular spray element to each of a plurality of rotational positions about the longitudinal axis thereof, and a second check value coupled to and rotatable with the second rotatable docking port, the second check valve movable between opened and closed positions and biased to the closed position when the connector of the second conduit is disengaged from the second rotatable docking port.

Consistent with another aspect of the invention, a dishwasher may include a wash tub, a rack supported in the wash tub and movable between loading and washing positions, where the rack is adjustable between first and second elevations within the wash tub, a tubular spray element supported by the rack for movement with the rack, the tubular spray element having a connector for receiving wash fluid, and a docking arrangement coupled to a rear wall of the wash tub and configured to engage with the connector of the tubular spray element when the rack is in the washing position to supply wash fluid to the tubular spray element. The docking arrangement may include a first rotatable docking port positioned to receive the connector of the tubular spray element when the rack is moved from the loading position to the washing position and the rack is adjusted to the first elevation, the first rotatable docking port being rotatable about a first axis of rotation and configured to engage the connector of the tubular spray element such that the tubular spray element rotates with rotation of the first rotatable docking port about the first axis of rotation when the connector of the tubular spray element is engaged by the first rotatable docking port, a second rotatable docking port positioned to receive the connector of the tubular spray element when the rack is moved from the loading position to the washing position and the rack is adjusted to the second elevation, the second rotatable docking port being rotatable about a second axis of rotation and configured to engage the connector of the tubular spray element such that the tubular spray element rotates with rotation of the second rotatable docking port about the second axis of rotation when the connector of the tubular spray element is engaged by the second rotatable docking port, a first check value coupled to and rotatable with the first rotatable docking port, the first check valve movable between opened and closed positions and biased to the closed position when the connector of the tubular spray element is disengaged from the first rotatable docking port, and a second check value coupled to and rotatable with the second rotatable docking port, the second check valve movable between opened and closed positions and biased to the closed position when the connector of the tubular spray element is disengaged from the second rotatable docking port. The dishwasher may further include a tubular spray element drive coupled to the first and second rotatable docking ports and configured to discretely direct the tubular spray element to each of a plurality of rotational positions about the longitudinal axis thereof when the tubular spray element is engaged by one of the first and second rotatable docking ports.

Also, in some embodiments, the first rotatable docking port includes a first fluid inlet configured to receive fluid, the second rotatable docking port includes a second fluid inlet configured to receive fluid, and the dishwasher further includes a first valve member disposed at a first predetermined rotational position about the first axis of rotation to restrict fluid flow to the tubular spray element when the fluid inlet is rotated to the predetermined rotational position, and a second valve member disposed at a second predetermined rotational position about the second axis of rotation to restrict fluid flow to the tubular spray element when the fluid inlet is rotated to the second predetermined rotational position.

Consistent with another aspect of the invention, a method of operating a dishwasher may include rotating a rotatable conduit supported by a rack supported in a wash tub of the dishwasher by rotating a rotatable docking port of a docking arrangement coupled to a rear wall of the wash tub about an axis of rotation, where the rotatable docking port is positioned to receive a connector of the conduit when the rack is moved from a loading position to a washing position, and where the rotatable docking port is configured to engage the connector of the conduit such that the conduit rotates about the axis of rotation along with rotation of the rotatable docking port, communicating fluid through a check value coupled to and rotatable with the rotatable docking port when the connector of the conduit is engaged with the rotatable docking port, the check valve movable between opened and closed positions and biased to the closed position when the connector of the conduit is disengaged from the rotatable docking port, and blocking fluid flow through the check valve when the connector of the conduit is disengaged from the rotatable docking port.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
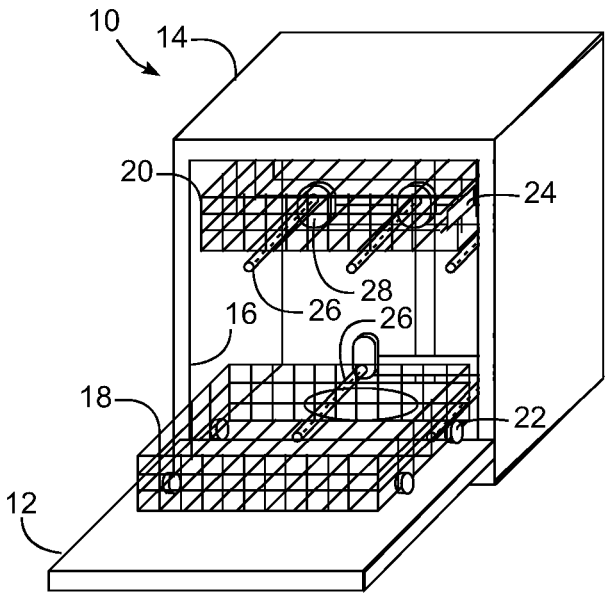
FIG. 1 is a perspective view of a dishwasher consistent with some embodiments of the invention.

In some embodiments consistent with the invention, one or more conduits supported by a dishwasher rack may be selectively docked with a wall-mounted docking arrangement including multiple and/or rotating docking ports, and optionally including a check valve and/or a diverter valve integrated with each docking port, as well as a return mechanism for biasing each conduit to a predetermined rotational position.

A conduit, in this regard, may be considered to be a body capable of communicating a fluid such as water, a wash fluid including water, detergent and/or another treatment composition, or pressurized air. A conduit may communicate fluid to one or more spray elements supported by a rack in some embodiments, while in other embodiments, a conduit itself may include one or more apertures or nozzles such that the conduit also functions as a spray element to spray fluid onto utensils within a wash tub. One particular type of conduit utilized in some embodiments of the invention is referred to herein as a tubular spray element, which may be considered to include an elongated body, which may be generally cylindrical in some embodiments but may also have other cross-sectional profiles in other embodiments, and which has one or more apertures disposed on an exterior surface thereof and in fluid communication with a fluid supply, e.g., through one or more internal passageways defined therein. A tubular spray element also has a longitudinal axis generally defined along its longest dimension and about which the tubular spray element rotates. Further, when a tubular spray element is mounted on a rack and configured to selectively engage with a dock based upon the position of the rack, this longitudinal axis may also be considered to be an axis of insertion. A tubular spray element may also have a cross-sectional profile that varies along the longitudinal axis, so it will be appreciated that a tubular spray element need not have a circular cross-sectional profile along its length as is illustrated in a number embodiments herein. In addition, the one or more apertures on the exterior surface of a tubular spray element may be arranged into nozzles in some embodiments, and may be fixed or movable (e.g., rotating, oscillating, etc.) with respect to other apertures on the tubular spray element. Further, the exterior surface of a tubular spray element may be defined on multiple components of a tubular spray element, i.e., the exterior surface need not be formed by a single integral component.

In addition, in some embodiments a tubular spray element may be discretely directed by a tubular spray element drive to multiple rotational positions about the longitudinal axis to spray a fluid in predetermined directions into a wash tub of a dishwasher during a wash cycle. In some embodiments, the tubular spray element may be operably coupled to such a drive through a docking arrangement that both rotates the tubular spray element and supplies fluid to the tubular spray element, as will become more apparent below. Further details regarding tubular spray elements may be found, for example, in U.S. Ser. No. 15/721,099, filed on Sep. 29, 2017 by Robert M. Digman et al., which is incorporated by reference herein.

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

In addition, consistent with some embodiments of the invention, dishwasher 10 may include one or more tubular spray elements (TSEs) 26 to direct a wash fluid onto utensils disposed in racks 18, 20. As will become more apparent below, tubular spray elements 26 are rotatable about respective longitudinal axes and are discretely directable by one or more tubular spray element drives (not shown in FIG. 1) to control a direction at which fluid is sprayed by each of the tubular spray elements. In some embodiments, fluid may be dispensed solely through tubular spray elements, however the invention is not so limited. For example, in some embodiments various upper and/or lower rotating spray arms may also be provided to direct additional fluid onto utensils. Still other sprayers, including various combinations of wall-mounted sprayers, rack-mounted sprayers, oscillating sprayers, fixed sprayers, rotating sprayers, focused sprayers, etc., may also be combined with one or more tubular spray elements in some embodiments of the invention.

Some tubular spray elements 26 may be fixedly mounted to a wall or other structure in wash tub 16, e.g., as may be the case for tubular spray elements 26 disposed below or adjacent lower rack 18. For other tubular spray elements 26, e.g., rack-mounted tubular spray elements, the tubular spray elements may be removably coupled to a docking arrangement such as docking arrangement 28 mounted to the rear wall of wash tub 16 in FIG. 1. Further details regarding docking arrangement 28 will be discussed below.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
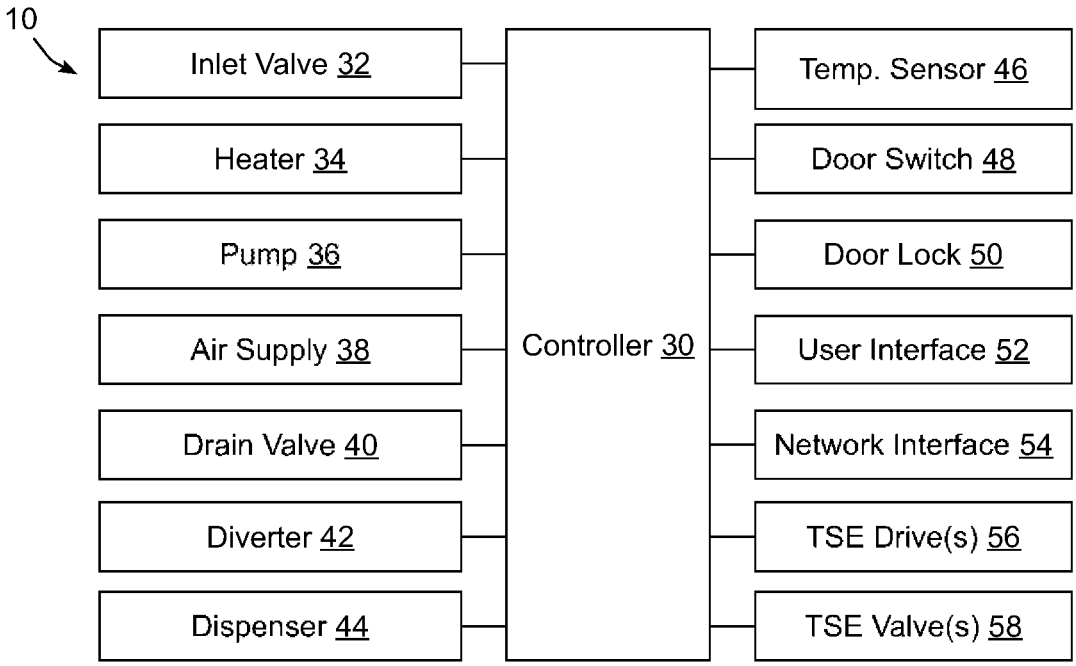
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that provides a source of pressurized air for use in drying utensils in the dishwasher, a drain valve 40 that is coupled to a drain to direct fluids out of the dishwasher, and a diverter 42 that controls the routing of pumped fluid to different tubular spray elements, spray arms and/or other sprayers during a wash cycle. In some embodiments, a single pump 36 may be used, and drain valve 40 may be configured to direct pumped fluid either to a drain or to the diverter 42 such that pump 36 is used both to drain fluid from the dishwasher and to recirculate fluid throughout the dishwasher during a wash cycle. In other embodiments, separate pumps may be used for draining the dishwasher and recirculating fluid. Diverter 42 in some embodiments may be a passive diverter that automatically sequences between different outlets, while in some embodiments diverter 42 may be a powered diverter that is controllable to route fluid to specific outlets on demand. In still other embodiments, and as will be discussed in greater detail below, each tubular spray element may be separately controlled such that no separate diverter is used. Air supply 38 may be implemented as an air pump or fan in different embodiments, and may include a heater and/or other air conditioning device to control the temperature and/or humidity of the pressurized air output by the air supply.

In the illustrated embodiment, pump 36 and air supply 38 collectively implement a fluid supply for dishwasher 100, providing both a source of wash fluid and pressurized air for use respectively during wash and drying operations of a wash cycle. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances. Pressurized air is generally used in drying operations, and may or may not be heated and/or dehumidified prior to spraying into a wash tub. It will be appreciated, however, that pressurized air may not be used for drying purposes in some embodiments, so air supply 38 may be omitted in some instances. Moreover, in some instances, tubular spray elements may be used solely for spraying wash fluid or spraying pressurized air, with other sprayers or spray arms used for other purposes, so the invention is not limited to the use of tubular spray elements for spraying both wash fluid and pressurized air.

Controller 30 may also be coupled to a dispenser 44 to trigger the dispensing of detergent and/or rinse agent into the wash tub at appropriate points during a wash cycle. Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure. For example, one or more tubular spray element (TSE) drives 56 and/or one or more tubular spray element (TSE) valves 58 may be provided in some embodiments to discretely control one or more tubular spray elements disposed in dishwasher 10, as will be discussed in greater detail below.

It will be appreciated that each tubular spray element drive 56 may also provide feedback to controller 30 in some embodiments, e.g., a current position and/or speed, although in other embodiments a separate position sensor may be used. In addition, as will become more apparent below, flow regulation to a tubular spray element may be performed without the use of a separately-controlled tubular spray element valve 58 in some embodiments, e.g., where rotation of a tubular spray element by a tubular spray element drive is used to actuate a mechanical valve.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Figure 3:
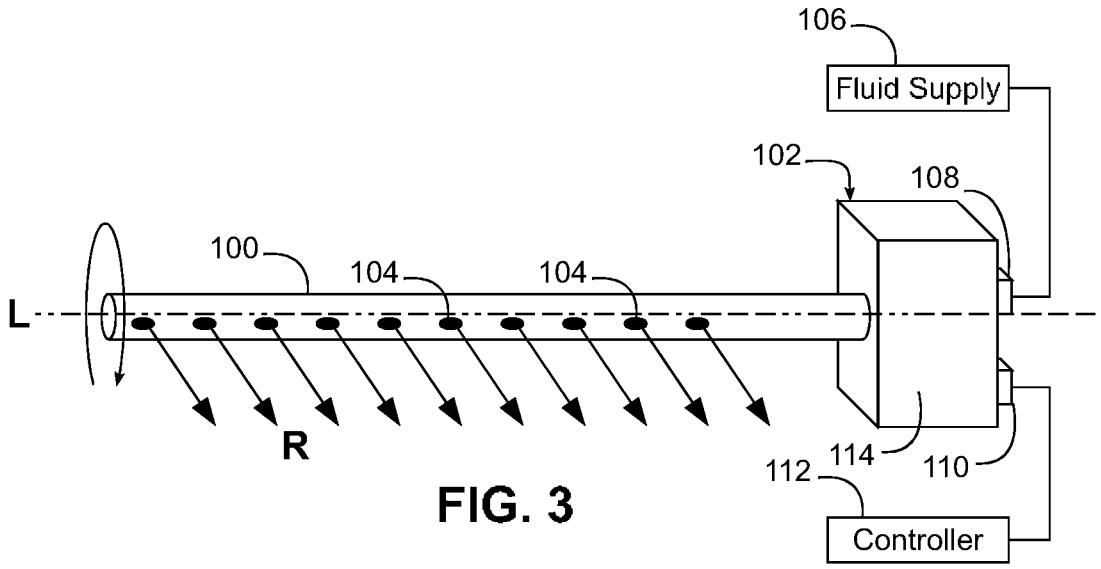
FIG. 3 is a side perspective view of a tubular spray element and tubular spray element drive from the dishwasher of FIG. 1.

Now turning to FIG. 3, in some embodiments, a dishwasher may include one or more discretely directable tubular spray elements, e.g., tubular spray element 100 coupled to a tubular spray element drive 102. Tubular spray element 100 may be configured as a tube or other elongated body disposed in a wash tub and being rotatable about a longitudinal axis L. In addition, tubular spray element 100 is generally hollow or at least includes one or more internal fluid passages that are in fluid communication with one or more apertures 104 extending through an exterior surface thereof. Each aperture 104 may function to direct a spray of fluid into the wash tub, and each aperture may be configured in various manners to provide various types of spray patterns, e.g., streams, fan sprays, concentrated sprays, etc. Apertures 104 may also in some instances be configured as fluidic nozzles providing oscillating spray patterns.

Moreover, as illustrated in FIG. 3, apertures 104 may all be positioned to direct fluid along a same radial direction from axis L, thereby focusing all fluid spray in generally the same radial direction represented by arrows R. In other embodiments, however, apertures may be arranged differently about the exterior surface of a tubular spray element, e.g., to provide spray from two, three or more radial directions, to distribute a spray over one or more arcs about the circumference of the tubular spray element, etc.

Tubular spray element 100 is in fluid communication with a fluid supply 106, e.g., through a port 108 of tubular spray element drive 102, to direct fluid from the fluid supply into the wash tub through the one or more apertures 104. Tubular spray element drive 102 is coupled to tubular spray element 100 and is configured to discretely direct the tubular spray element 100 to each of a plurality of rotational positions about longitudinal axis L. By "discretely directing," what is meant is that tubular spray element drive 102 is capable of rotating tubular spray element 100 generally to a controlled rotational angle (or at least within a range of rotational angles) about longitudinal axis L. Thus, rather than uncontrollably rotating tubular spray element 100 or uncontrollably oscillating the tubular spray element between two fixed rotational positions, tubular spray element drive 102 is capable of intelligently focusing the spray from tubular spray element 100 between multiple rotational positions. It will also be appreciated that rotating a tubular spray element to a controlled rotational angle may refer to an absolute rotational angle (e.g., about 10 degrees from a home position) or may refer to a relative rotational angle (e.g., about 10 degrees from the current position).

Tubular spray element drive 102 is also illustrated with an electrical connection 110 for coupling to a controller 112, and a housing 114 is illustrated for housing various components in tubular spray element drive 102 that will be discussed in greater detail below. In the illustrated embodiment, tubular spray element drive 102 is configured as a base that supports, through a rotary coupling, an end of the tubular spray element and effectively places the tubular spray element in fluid communication with port 108.

By having an intelligent control provided by tubular spray element drive 102 and/or controller 112, spray patterns and cycle parameters may be increased and optimized for different situations. For instance, tubular spray elements near the center of a wash tub may be configured to rotate 360 degrees, while tubular spray elements located near wash tub walls may be limited to about 180 degrees of rotation to avoid spraying directly onto any of the walls of the wash tub, which can be a significant source of noise in a dishwasher. In another instance, it may be desirable to direct or focus a tubular spray element to a fixed rotational position or over a small range of rotational positions (e.g., about 5-10 degrees) to provide concentrated spray of liquid, steam and/or air, e.g., for cleaning silverware or baked on debris in a pan. In addition, in some instances the rotational velocity of a tubular spray element could be varied throughout rotation to provide longer durations in certain ranges of rotational positions and thus provide more concentrated washing in particular areas of a wash tub, while still maintaining rotation through 360 degrees. Control over a tubular spray element may include control over rotational position, speed or rate of rotation and/or direction of rotation in different embodiments of the invention.

Figure 4:
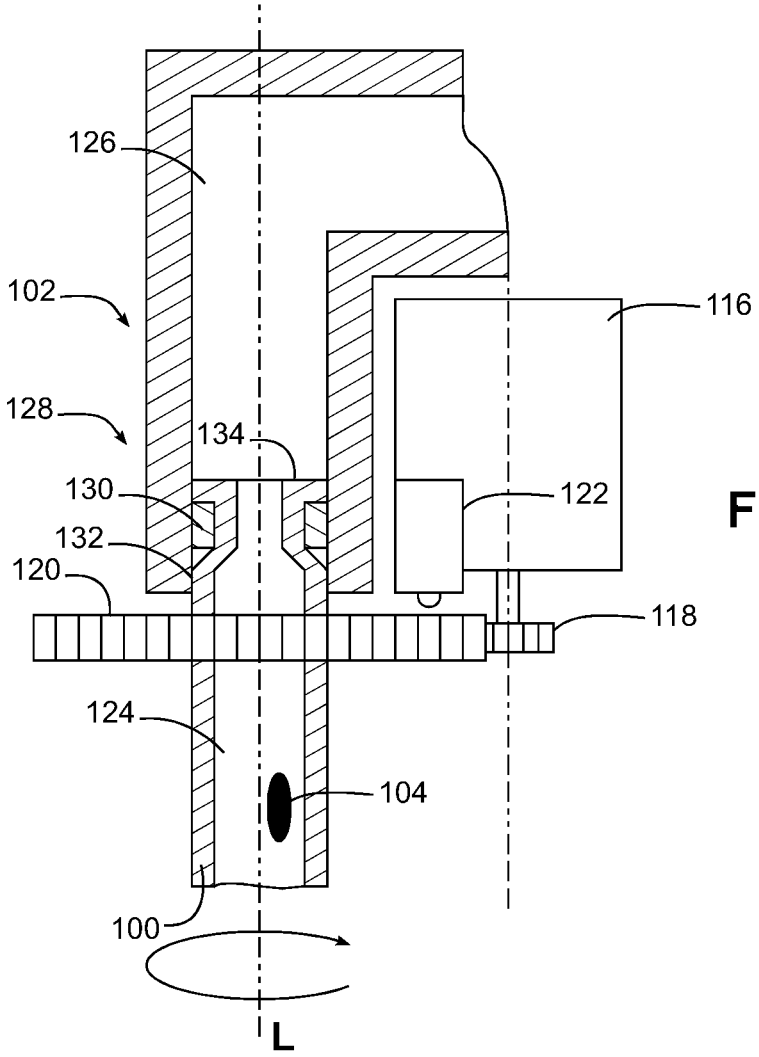
FIG. 4 is a partial cross-sectional view of the tubular spray element and tubular spray element drive of FIG. 3.

FIG. 4 illustrates one example implementation of tubular spray element 100 and tubular spray element drive 102 in greater detail, with housing 114 omitted for clarity. In this implementation, tubular spray element drive 102 includes an electric motor 116, which may be an alternating current (AC) or direct current (DC) motor, e.g., a brushless DC motor, a stepper motor, etc., which is mechanically coupled to tubular spray element 100 through a gearbox including a pair of gears 118, 120 respectively coupled to motor 116 and tubular spray element 100. Other manners of mechanically coupling motor 116 to tubular spray element 100 may be used in other embodiments, e.g., different numbers and/or types of gears, belt and pully drives, magnetic drives, hydraulic drives, linkages, friction, etc.

In addition, an optional position sensor 122 may be disposed in tubular spray element drive 102 to determine a rotational position of tubular spray element 100 about axis L. Position sensor 122 may be an encoder or hall sensor in some embodiments, or may be implemented in other manners, e.g., integrated into a stepper motor, whereby the rotational position of the motor is used to determine the rotational position of the tubular spray element. Position sensor 122 may also sense only limited rotational positions about axis L (e.g., a home position, 30 or 45 degree increments, etc.). Further, in some embodiments, rotational position may be controlled using time and programming logic, e.g., relative to a home position, and in some instances without feedback from a motor or position sensor. Position sensor 122 may also be external to tubular spray element drive 102 in some embodiments.

An internal passage 124 in tubular spray element 100 is in fluid communication with an internal passage 126 leading to port 108 (not shown in FIG. 4) in tubular spray element drive 102 through a rotary coupling 128. In one example implementation, coupling 128 is formed by a bearing 130 mounted in passageway 126, with one or more deformable tabs 134 disposed at the end of tubular spray element 100 to secure tubular spray element 100 to tubular spray element drive 102. A seal 132, e.g., a lip seal, may also be formed between tubular spray element 100 and tubular spray element drive 102. Other manners of rotatably coupling the tubular spray element while providing fluid flow may be used in other embodiments.

Figure 5:
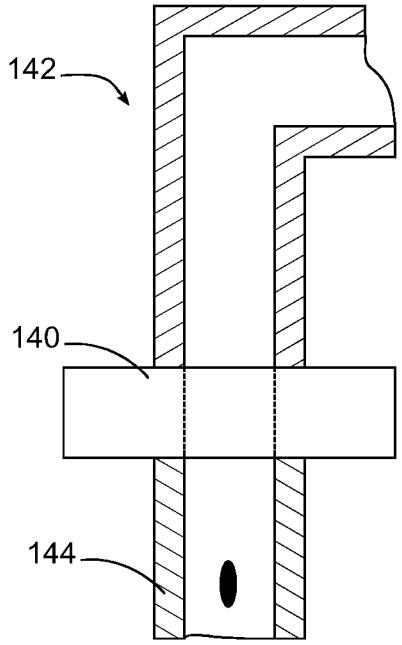
FIG. 5 is a partial cross-sectional view of another tubular spray element and tubular spray element drive consistent with some embodiments of the invention, and including a valve for restricting flow to the tubular spray element.

Turning to FIG. 5, it also may be desirable in some embodiments to incorporate a valve 140 into a tubular spray element drive 142 to regulate the fluid flow to a tubular spray element 144 (other elements of drive 142 have been omitted from FIG. 5 for clarity). Valve 140 may be an on/off valve in some embodiments or may be a variable valve to control flow rate in other embodiments. In still other embodiments, a valve may be external to or otherwise separate from a tubular spray element drive, and may either be dedicated to the tubular spray element or used to control multiple tubular spray elements. Valve 140 may be integrated with or otherwise proximate a rotary coupling between tubular spray element 144 and tubular spray element drive 142. By regulating fluid flow to tubular spray elements, e.g., by selectively shutting off tubular spray elements, water can be conserved and/or high-pressure zones can be created by pushing all of the hydraulic power through fewer numbers of tubular spray elements.

In some embodiments, valve 140 may be actuated independent of rotation of tubular spray element 144, e.g., using an iris valve, butterfly valve, gate valve, plunger valve, piston valve, valve with a rotatable disc, ball valve, etc., and actuated by a solenoid, motor or other separate mechanism from the mechanism that rotates tubular spray element 144. In other embodiments, however, valve 140 may be actuated through rotation of tubular spray element 144. In some embodiments, for example, rotation of tubular spray element 144 to a predetermined rotational position may be close valve 140, e.g., where valve 140 includes an arcuate channel that permits fluid flow over only a range of rotational positions.

Figure 6:
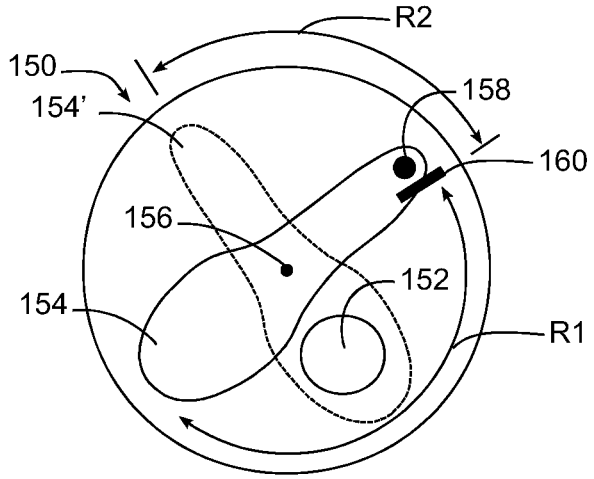
FIG. 6 is one example implementation of the valve referenced in FIG. 5.

As another example, and as illustrated by valve 150 of FIG. 6, a valve may be actuated through over-rotation of a tubular spray element. Valve 150, for example, includes a port 152 that is selectively shut by a gate 154 that pivots about a pin 156. Gate 154 is biased (e.g., via a spring) to the position shown via solid line in FIG. 6, and includes a leg 158 that selectively engages a stop 160 at a predetermined rotational position representing an end of a range R1 of active spray positions for the tubular spray element. When a tubular spray element is rotated beyond range R1, e.g., within range R2, leg 158 engages with stop 160 to pivot gate 154 to the position 154' shown in dotted line and seal port 152.

Figure 7:
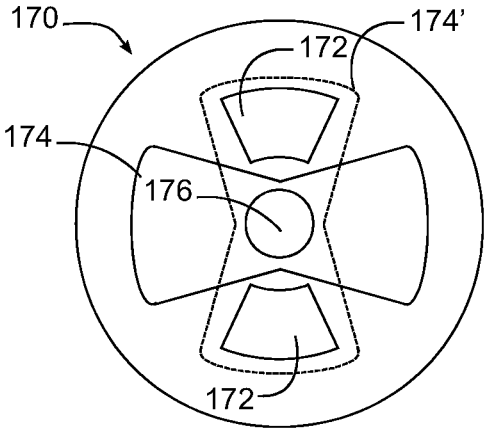
FIG. 7 is another example implementation of the valve referenced in FIG. 5.

As yet another example, and as illustrated by valve 170 of FIG. 7, a valve may be actuated through counter rotation of a tubular spray element. Valve 170, for example, includes a pair of ports 172 that are selectively shut by a gate 174 that pivots about a one way bearing 176. Gate 174 is biased (e.g., via a spring) to the position shown via solid line in FIG. 7, and when the tubular spray element is rotated in a clockwise direction, gate 174 is maintained in a position that permits fluid flow through ports 172. Upon counter-clockwise rotation, however, gate 174 is rotated to position 174' shown in dotted line to seal ports 172 through the action of one way bearing 176.

Figure 8:
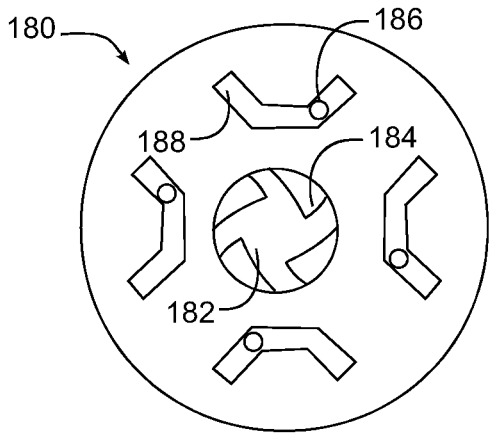
FIG. 8 is yet another first example implementation of the valve referenced in FIG. 5.

As yet another example, and as illustrated by valve 180 of FIG. 8, a valve 180 may be a variable valve, e.g., an iris valve, including a port 182 that is selectively regulated by a plurality of iris members 184. Each iris member 184 includes a pin 186 that rides in a track 188 to vary an opening size of port 182. Valve 180 may be independently actuated from rotation of a tubular spray element in some embodiments (e.g., via a solenoid or motor), or may be actuated through rotation of a tubular spray element, e.g., through rotation to a predetermined position, an over-rotation, or a counter-rotation, using appropriate mechanical linkages.

It should also be noted that with the generally U-shape of track 188, valve 180 may be configured in some embodiments to close through counter-rotation by a predetermined amount, yet still remain open when rotated in both directions. Specifically, valve 180 may be configured such that, the valve is open when pin 186 is disposed in either leg of the U-shaped track, but is closed when pin 186 is disposed in the central portion of the track having the shortest radial distance from the centerline of the valve. Valve 180 may be configured such that, when the tubular spray element is rotating in one direction and pin 186 is disposed at one end of track 188, the valve is fully open, and then when the tubular spray element is counter-rotated in an opposite direction a first predetermined amount (e.g., a predetermined number of degrees) the pin 186 travels along track 188 to the central portion to fully close the valve. Then, when the tubular spray element is counter-rotated in the opposite direction beyond the first predetermined about, the pin 186 continues to travel along track 188 to the opposite end, thereby reopening the valve such that the valve will remain open through continued rotation in the opposite direction.

Figure 9:
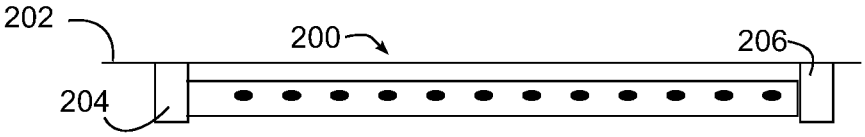
FIG. 9 is a functional top plan view of an example implementation of a wall-mounted tubular spray element and tubular spray element drive consistent with some embodiments of the invention.
Figure 10:
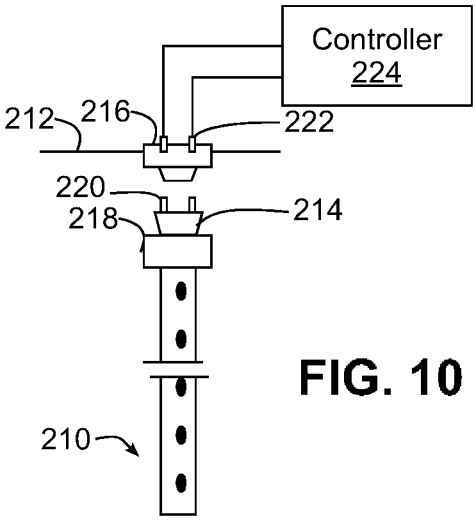
FIG. 10 is a functional top plan view of an example implementation of a rack-mounted tubular spray element and tubular spray element drive consistent with some embodiments of the invention.
Figure 11:
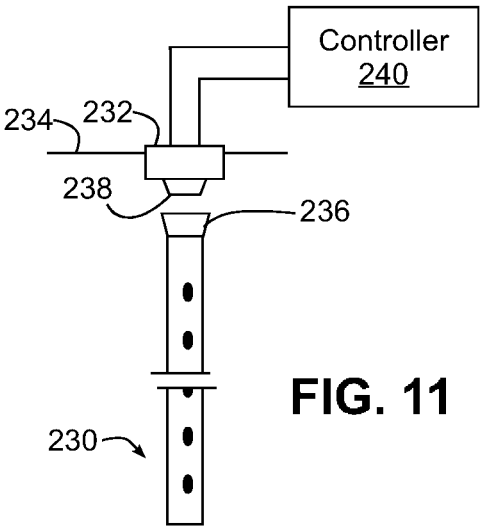
FIG. 11 is a functional top plan view of another example implementation of a rack-mounted tubular spray element and tubular spray element drive consistent with some embodiments of the invention.

Now turning to FIGS. 9-11, tubular spray elements may be mounted within a wash tub in various manners in different embodiments. As illustrated by FIGS. 1 and 3 (discussed above), a tubular spray element in some embodiments may be mounted to a wall (e.g., a side wall, a back wall, a top wall, a bottom wall, or a door) of a wash tub, and may be oriented in various directions, e.g., horizontally, vertically, front-to-back, side-to-side, or at an angle. It will also be appreciated that a tubular spray element drive may be disposed within a wash tub, e.g., mounted on wall of the wash tub or on a rack or other supporting structure, or alternatively some or all of the tubular spray element drive may be disposed external from a wash tub, e.g., such that a portion of the tubular spray element drive or the tubular spray element projects through an aperture in the wash tub. Alternatively, a magnetic drive could be used to drive a tubular spray element in the wash tub using an externally-mounted tubular spray element drive.

Moreover, as illustrated by tubular spray element 200 of FIG. 9, rather than being mounted in a cantilevered fashion as is the case with tubular spray element 100 of FIG. 3, a tubular spray element may also be mounted on a wall 202 of a wash tub and supported at both ends by hubs 204, 206, one or both of which may include the components of the tubular spray element drive. In this regard, the tubular spray element 200 runs generally parallel to wall 202 rather than running generally perpendicular thereto, as is the case with tubular spray element 100 of FIG. 3.

In still other embodiments, a tubular spray element may be rack-mounted. FIG. 10, for example, illustrates a tubular spray element 210 mountable on rack (not shown) and dockable via a dock 214 to a docking port 216 on a wall 212 of a wash tub. In this embodiment, a tubular spray element drive 218 is also rack-mounted, and as such, in addition to a fluid coupling between dock 214 and docking port 216, a plurality of cooperative contacts 220, 222 are provided on dock 214 and docking port 216 to provide power to tubular spray element drive 218 as well as electrical communication with a controller 224.

As an alternative, and as illustrated in FIG. 11, a tubular spray element 230 may be rack-mounted, but separate from a tubular spray element drive 232 that is not rack-mounted, but is instead mounted to a wall 234 of a wash tub. A dock 236 and docking port 238 provide fluid communication with tubular spray element 230, along with a capability to rotate tubular spray element 230 about its longitudinal axis under the control of tubular spray element drive 232. Control over tubular spray element drive 232 is provided by a controller 240. In some instances, tubular spray element drive 232 may include a rotatable and keyed channel into which an end of a tubular spray element may be received.

Figure 12:
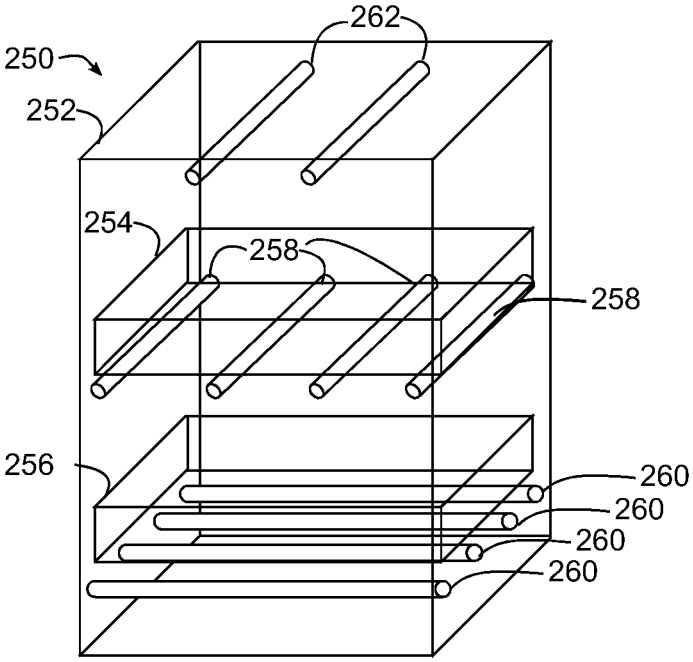
FIG. 12 is a functional perspective view of a dishwasher incorporating multiple tubular spray elements and consistent with some embodiments of the invention.

FIG. 12 next illustrates a dishwasher 250 including a wash tub 252 and upper and lower racks 254, 256, and with a number of tubular spray elements 258, 260, 262 distributed throughout the wash tub 252 for circulating a wash fluid through the dishwasher. Tubular spray elements 258 may be rack-mounted, supported on the underside of upper rack 254, and extending back-to-front within wash tub 252. Tubular spray elements 258 may also dock with back wall-mounted tubular spray element drives (not shown in FIG. 12), e.g., as discussed above in connection with FIG. 11. In addition, tubular spray elements 258 may be rotatably supported at one or more points along their respective longitudinal axes by couplings (not shown) suspended from upper rack 254. Tubular spray elements 258 may therefore spray upwardly into upper rack 254 and/or downwardly onto lower rack 256, and in some embodiments, may be used to focus wash fluid onto a silverware basket or other region of either rack to provide for concentrated washing. Tubular spray elements 260 may be wall-mounted beneath lower rack 256, and may be supported at both ends on the side walls of wash tub 252 to extend in a side-to-side fashion, and generally transverse to tubular spray elements 258. Each tubular spray element 258, 260 may have a separate tubular spray element drive in some embodiments, while in other embodiments some or all of the tubular spray elements 258, 260 may be mechanically linked and driven by common tubular spray element drives.

In some embodiments, tubular spray elements 258, 260 by themselves may provide sufficient washing action and coverage. In other embodiments, however, additional tubular spray elements, e.g., tubular spray elements 262 supported above upper rack 254 on one or both of the top and back walls of wash tub 252, may also be used. In addition, in some embodiments, additional spray arms and/or other sprayers may be used. It will also be appreciated that while 10 tubular spray elements are illustrated in FIG. 12, greater or fewer numbers of tubular spray elements may be used in other embodiments.

It will also be appreciated that in some embodiments, multiple tubular spray elements may be driven by the same tubular spray element drive, e.g., using geared arrangements, belt drives, or other mechanical couplings. Further, tubular spray elements may also be movable in various directions in addition to rotating about their longitudinal axes, e.g., to move transversely to a longitudinally axis, to rotate about an axis of rotation that is transverse to a longitudinal axis, etc. In addition, deflectors may be used in combination with tubular spray elements in some embodiments to further the spread of fluid and/or prevent fluid from hitting tub walls. In some embodiments, deflectors may be integrated into a rack, while in other embodiments, deflectors may be mounted to a wall of the wash tub. In addition, deflectors may also be movable in some embodiments, e.g., to redirect fluid between multiple directions. Moreover, while in some embodiments tubular spray elements may be used solely to spray wash fluid, in other embodiments tubular spray elements may be used to spray pressurized air at utensils during a drying operation of a wash cycle, e.g., to blow off water that pools on cups and dishes after rinsing is complete. In some instances, different tubular spray elements may be used to spray wash fluid and spray pressurized air, while in other instances the same tubular spray elements may be used to alternately or concurrently spray wash liquid and pressurized air.

Now turning to FIGS. 13-17, these figures illustrate an example rack-mounted tubular spray element system 300 suitable for use, for example, in dishwasher 10 of FIG. 1. Tubular spray element system 300 includes a docking arrangement 302 supporting docking with three rack-mounted tubular spray elements 304, 306, 308 rotatably supported on a rack 310 (of which only portions of a few wires are shown) by a rack mount 312. Tubular spray elements 304 and 308 will hereafter be referred to as side tubular spray elements as they are disposed toward the left and right sides of rack 310, while tubular spray element 306 will hereinafter be referred to as a central tubular spray element as it is disposed more centrally on rack 310. As will be discussed in greater detail below, rack mount 312 may include one or more return mechanisms to return each tubular spray element 304-308 to a "home" position when undocked from docking arrangement 302. Furthermore, multiple rack mounts 312 may be used in some embodiments to support each tubular spray element 304-308 at multiple points along the longitudinal axes thereof, and while a single rack mount 312 is illustrated supporting all three tubular spray elements 304-308, in other embodiments each tubular spray element may be supported by one or more separate rack mounts.

In the illustrated embodiment, docking arrangement 302 includes multiple docking ports for each tubular spray element to support adjustment of rack 310 at multiple elevations in the wash tub, i.e., upper docking ports 314, 316, 318 and lower docking ports 320, 322, 324. In particular, in many dishwasher designs, it is desirable to enable a consumer to raise and lower the elevation of an upper rack in order to support different types of loads, e.g., where larger items need to be placed in the lower or upper rack. Various manners of adjusting the elevation of a rack may be used in different embodiments, as will be appreciated by those of ordinary skill in the art having the benefit of the instant disclosure. For the purposes of this example, it can be assumed that rack 310 includes suitable mechanisms to move the rack between an upper elevation where tubular spray elements 304-308 are received in upper docking ports 314-318, and a lower elevation where tubular spray elements 304-308 are received in lower docking ports 320-324.

Figure 13:
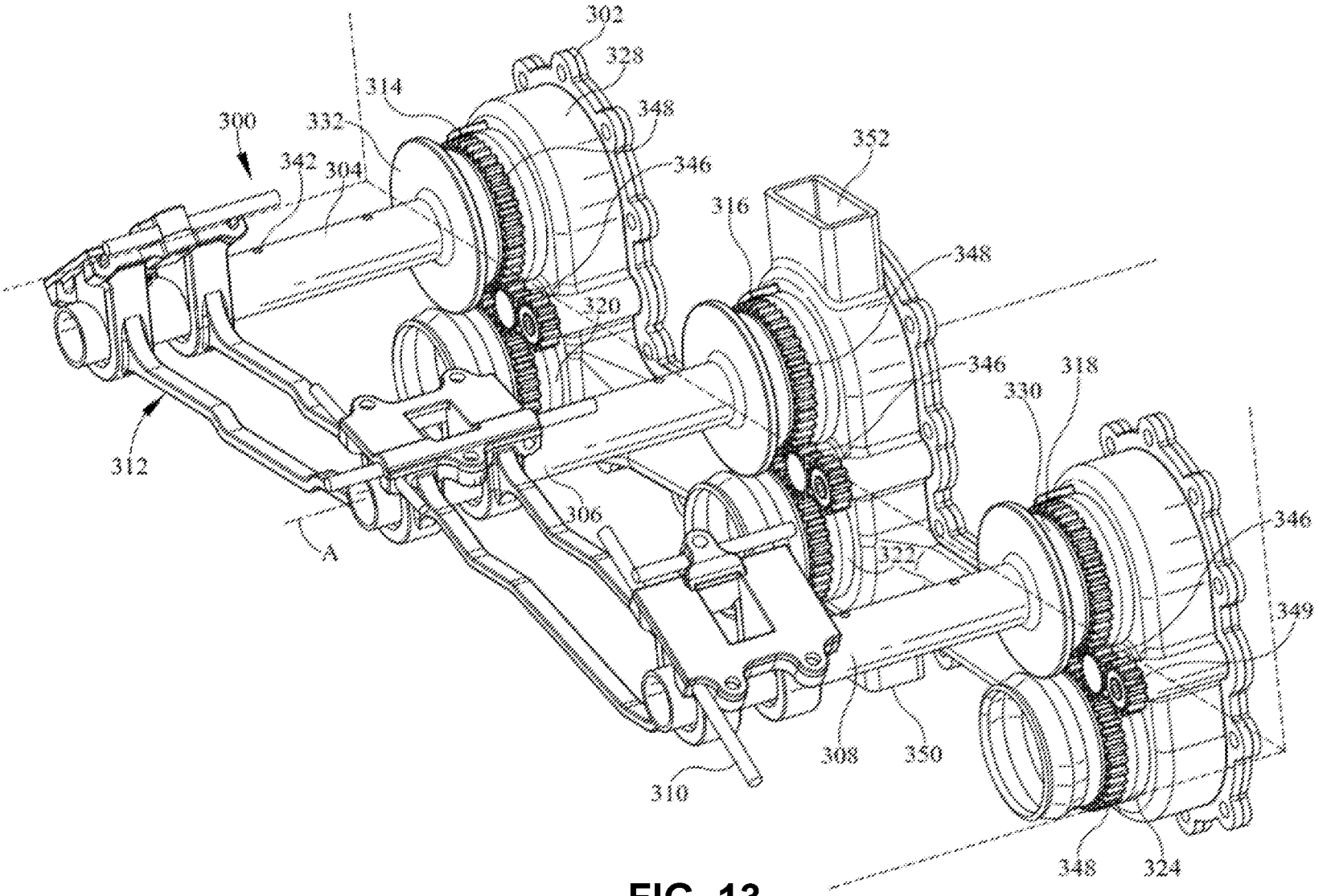
FIG. 13 is a perspective view of an example implementation of rack-mounted tubular spray elements docked to a docking arrangement consistent with some embodiments of the invention.
Figure 14:
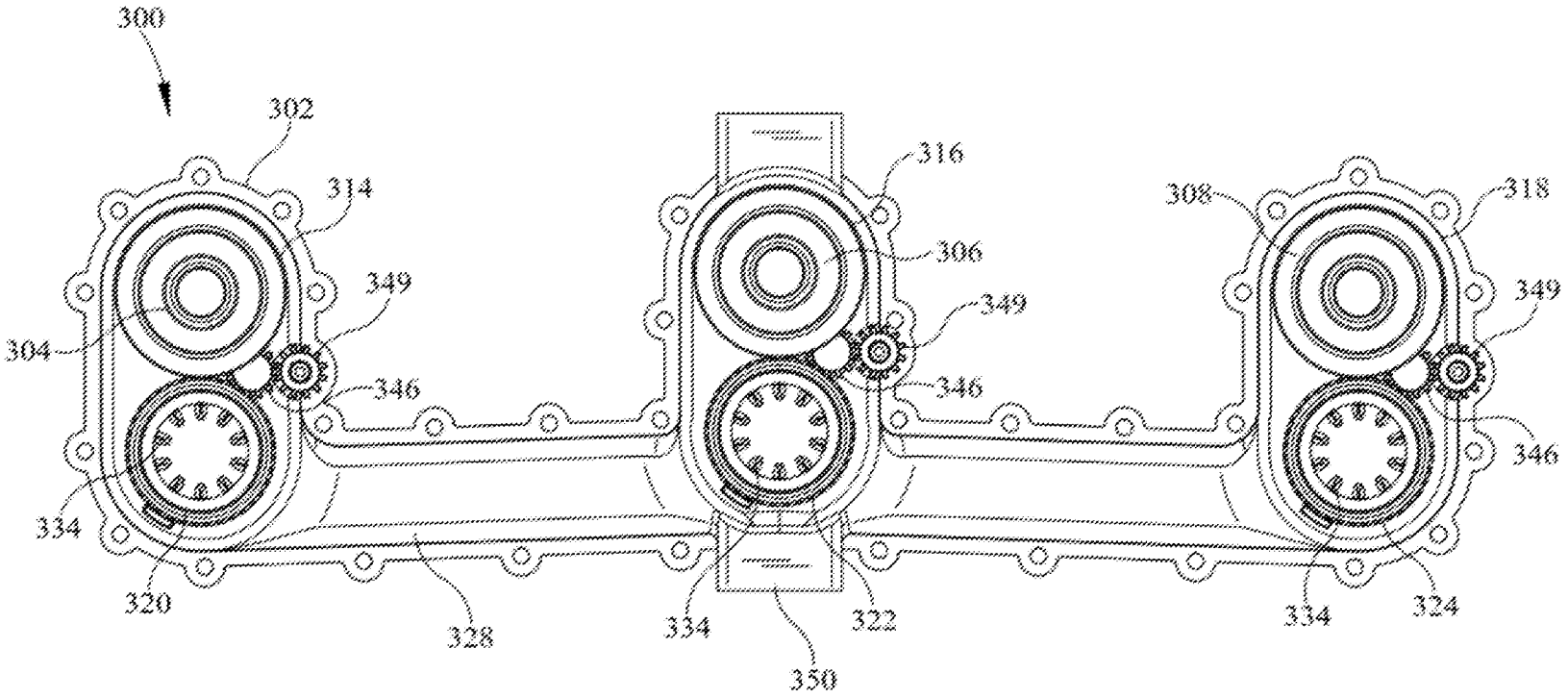
FIG. 14 is a front elevational view of the example implementation of FIG. 13.

Also in the illustrated embodiment, each docking port 314-324 is rotatable about an axis of insertion of its respective tubular spray element (e.g., axis A of FIG. 13 for tubular spray element 306). Axis A may therefore be considered to additionally be an axis of rotation of both the docking port and its respective tubular spray element. In addition, axis A may also be considered to be a longitudinal axis for tubular spray element 306, although it will be appreciated that the longitudinal axis of a tubular spray element, the axis of insertion of the tubular spray element, the axis of rotation of the tubular spray element and the axis of rotation of the docking port need not all be coextensive with one another in other embodiments.

Rotatable Docking Ports and Check and/or Diverter Valves for Use Therewith

With reference to FIGS. 13-17, each docking port 314-324 is rotatably received in a circular aperture 326 in a housing 328 that is secured to a rear wall of the wash tub. Each docking port 314-324 includes a gasket 330 configured to form a seal with a corresponding flange 332 on each tubular spray element 304-308, and may be configured as a bellows gasket in some embodiments. Furthermore, each docking port 314-324 includes an internal set of teeth 334 configured to engage with corresponding teeth 336 on an end connector 338 of each tubular spray element 304-308 such that rotation of a docking port 314-324 causes rotation of the respective tubular spray element when connector 338 is received within the docking port. Furthermore, each connector 338 includes one or more inlet ports 340 to receive fluid from docking arrangement 302, with the respective gasket 330 providing a seal such that the fluid is conveyed through the tubular spray element and out of one or more apertures 342 along the surface of the tubular spray element. It will be appreciated that other mechanical couplings may be used to rotationally lock a tubular spray element with a docking port, so the invention is not limited to the particular arrangement of teeth illustrated herein.

Figure 15:
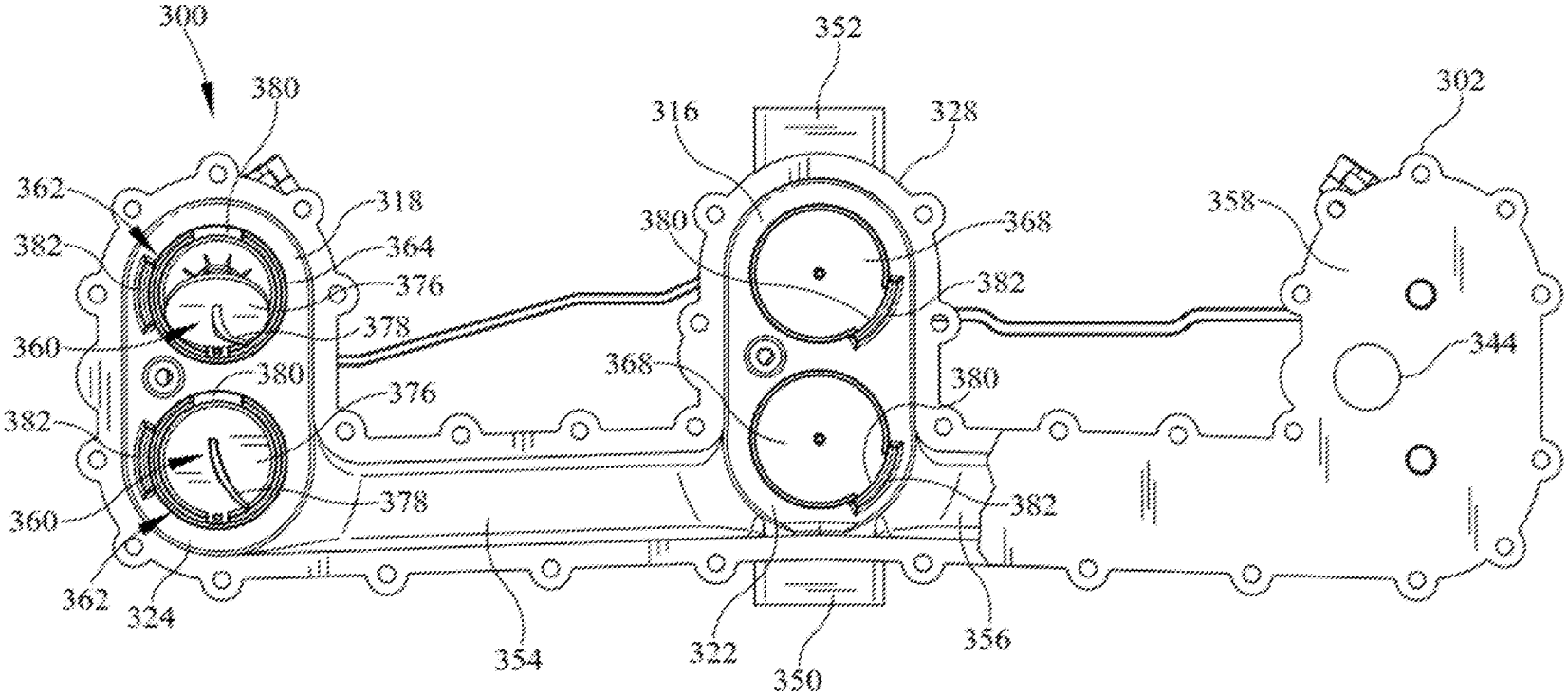
FIG. 15 is a rear elevational view of the example implementation of FIG. 13, with portions thereof cut away.

Rotation of each docking port may be implemented using a docking port drive, or tubular spray element drive, which in the illustrated embodiment comprises a stepper motor 344, one of which is illustrated in FIG. 15. Coupled to a drive shaft of each stepper motor 344 is a pinion gear 346 that is configured to engage a gear 348 formed on the outside surface of each docking port 314-324 such that one docking port drive is capable of concurrently driving both the upper and lower docking ports for a particular tubular spray element. An idler gear 349 may also be used in some embodiments to balance the load on each pinion gear 346.

As such, a total of three docking port drives are used for docking arrangement 302, thereby supporting individual control over the rotational position of each tubular spray element regardless of whether it is docked in the upper docking port or lower docking port. In other embodiments, one docking port drive may be coupled to drive multiple tubular spray elements, and in still other embodiments, separate docking port drives may be used to drive the upper and lower docking ports for a given tubular spray elements. Moreover, as discussed above, other motors and drives may be used as an alternative to stepper motors, and in some embodiments, separate position sensors may be used to sense the position of the tubular spray element.

With particular reference to FIG. 15, housing 328 of docking arrangement 302 may serve as a manifold to convey fluid to all of docking ports 314-324. Given housing 328's placement on the rear wall of the wash tub and at an intermediate elevation suitable for positioning tubular spray elements beneath and/or within an upper rack, housing 328 may include a lower inlet port 350 that receives fluid from a fluid supply (e.g., via a first generally vertical conduit disposed along the rear wall of the wash tub) as well as an upper outlet port 352 that conveys fluid to one or more upper sprayers (e.g., a ceiling-mounted spray arm or one or more tubular spray elements disposed above the upper rack). Furthermore, a pair of lateral channels 354, 356 convey fluid received from lower port 350 to docking ports 314, 318, 320 and 324 for side tubular spray elements 304 and 308. In other embodiments, other arrangements of ports may be used, e.g., no upper port if no sprayers are disposed above rack 310, or no lateral channels such that each docking port or each pair of upper and lower docking ports is supplied with fluid separately. Housing 328 may also include a rear cover 358 as illustrated in FIG. 15.

Now with particular reference to FIGS. 14-17, each docking port in the illustrated embodiment includes both an integrated check valve 360 and integrated diverter valve 362. Each integrated check valve 360 is used to block fluid flow from a docking port when a tubular spray element is not coupled to the docking port, e.g., such that if rack 310 is in an upper elevation and tubular spray elements 304-308 are engaged with upper docking ports 314-318, the check valves 360 for each of lower docking ports 320-324 will remain closed so that fluid does not flow through the lower docking ports. Each integrated diverter valve 362 is used to control fluid flow to a tubular spray element based upon a rotational position of the docking port, i.e., so that fluid flow is controllably allowed or restricted at predetermined rotational positions of the docking port, and thus, the tubular spray element coupled thereto.

To support both types of valves, each docking port in the embodiment illustrated in FIGS. 13-17 includes a valve body 364 that is positioned in the interior of housing 328 and that engages a gear body 366 that is exterior of housing 328 through an aperture 326 in housing 328, e.g., via a snap or press fit arrangement, using adhesives and/or fasteners, or in other manners that will be apparent to those of ordinary skill having the benefit of the instant disclosure. Gasket 330 is secured to gear body 366, while a cover 368 (illustrated in place for docking ports 316 and 322 in FIG. 15) is secured to valve body 364 to form a rear surface thereof, e.g., via a snap or press fit arrangement, using adhesives and/or fasteners, or in other manners that will be apparent to those of ordinary skill having the benefit of the instant disclosure.

With respect to check valve 360, valve body 364 includes an annular valve seat 370 and a projection 372 that is configured to retain a tab 374 of a flap 376 that functions as a check valve for the docking port. In the illustrated embodiment, valve body 364 is generally cylindrical in cross-section, and as such a main portion of flap 376 is circular in shape to form a seal along the perimeter of annular valve seat 368 when closed. It will also be appreciated that flap 376 in the illustrated embodiment rotates with valve body 364, although in some embodiments a check valve may not rotate with the valve body.

Figure 17:
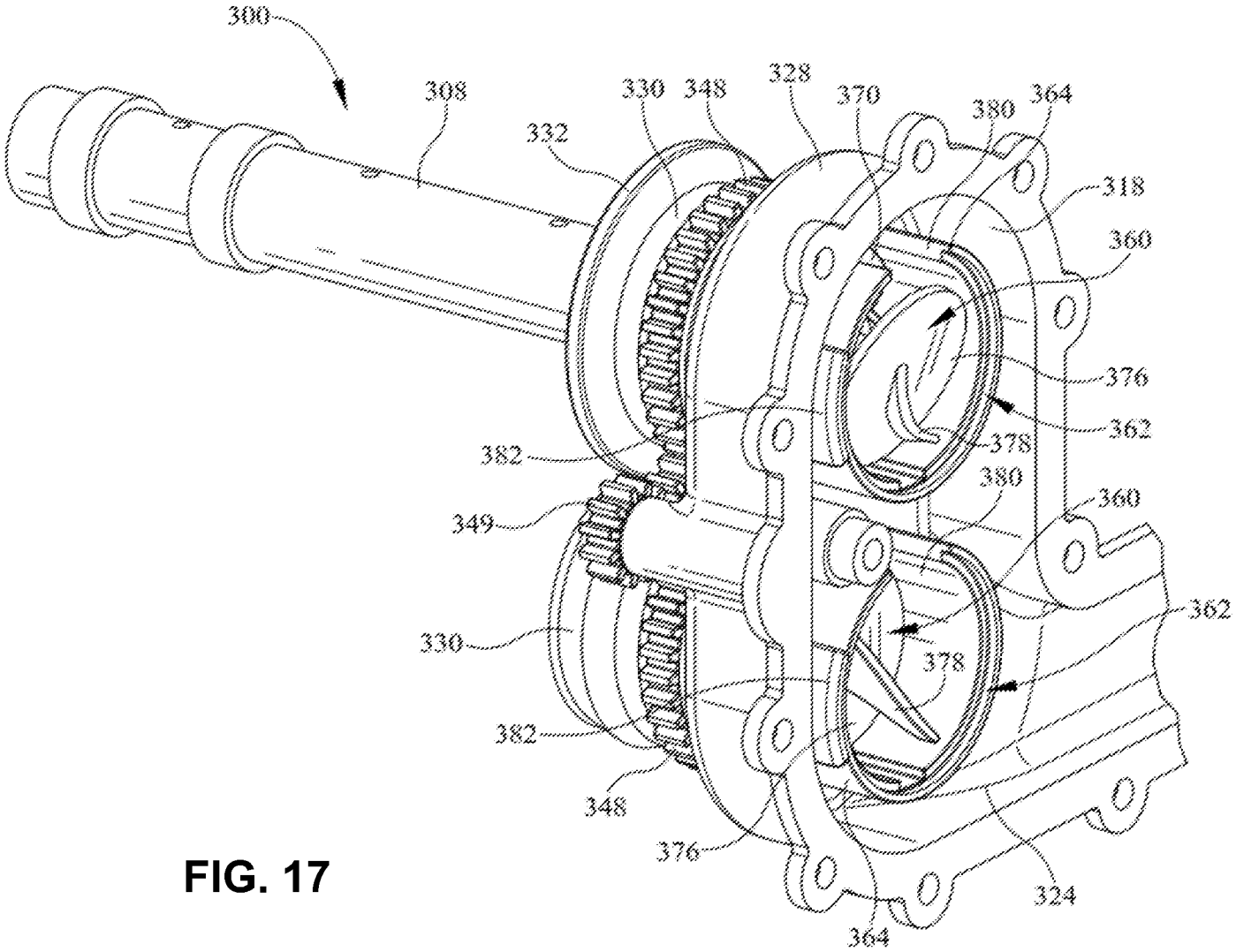
FIG. 17 is a rear perspective view of a portion of the example implementation of FIG. 13.

Flap 376 also includes a biasing member 378, here implemented as a transverse fin, that biases flap 376 to a closed position when the connector 338 of a tubular spray element is not engaged with the docking port, e.g., as illustrated for lower docking port 324 in both FIG. 15 and FIG. 17. Biasing member 378 pushes against rear cover 368 to maintain check valve 360 in a closed position, and upon insertion of connector 338 of a tubular spray element, flap 376 is displaced rearwardly to disengage from valve seat 370 and open check valve 360, e.g., as illustrated for upper docking port 318 in both FIG. 15 and FIG. 17. As also illustrated in these figures, biasing member 378 may fold over or otherwise bend as the biasing force is overcome by the insertion of connector 338. As such, it may be desirable in some embodiments to form biasing member 378 integrally with flap 376, e.g., using silicone, rubber, or another suitable elastomeric material.

In addition, with respect to diverter valve 362, valve body 364 includes an inlet 380 for receiving fluid. In the illustrated embodiment, inlet 380 is formed in a substantially cylindrical sidewall of valve body 364 such that inlet 380 is a radially-facing inlet as the inlet faces generally in a radial direction from the rotational axis of the valve body. In other embodiments, however, an inlet may be formed elsewhere on a valve body, e.g., on a rear surface such as on cover 368. In either instance, the inlet rotates with the valve body such that fluid flow may be received at various rotational positions about the rotational axis. In addition, in the illustrated embodiment, each inlet 380 faces in generally the same direction as the apertures 342 of an associated tubular spray element, although the invention is not so limited.

Figure 16:
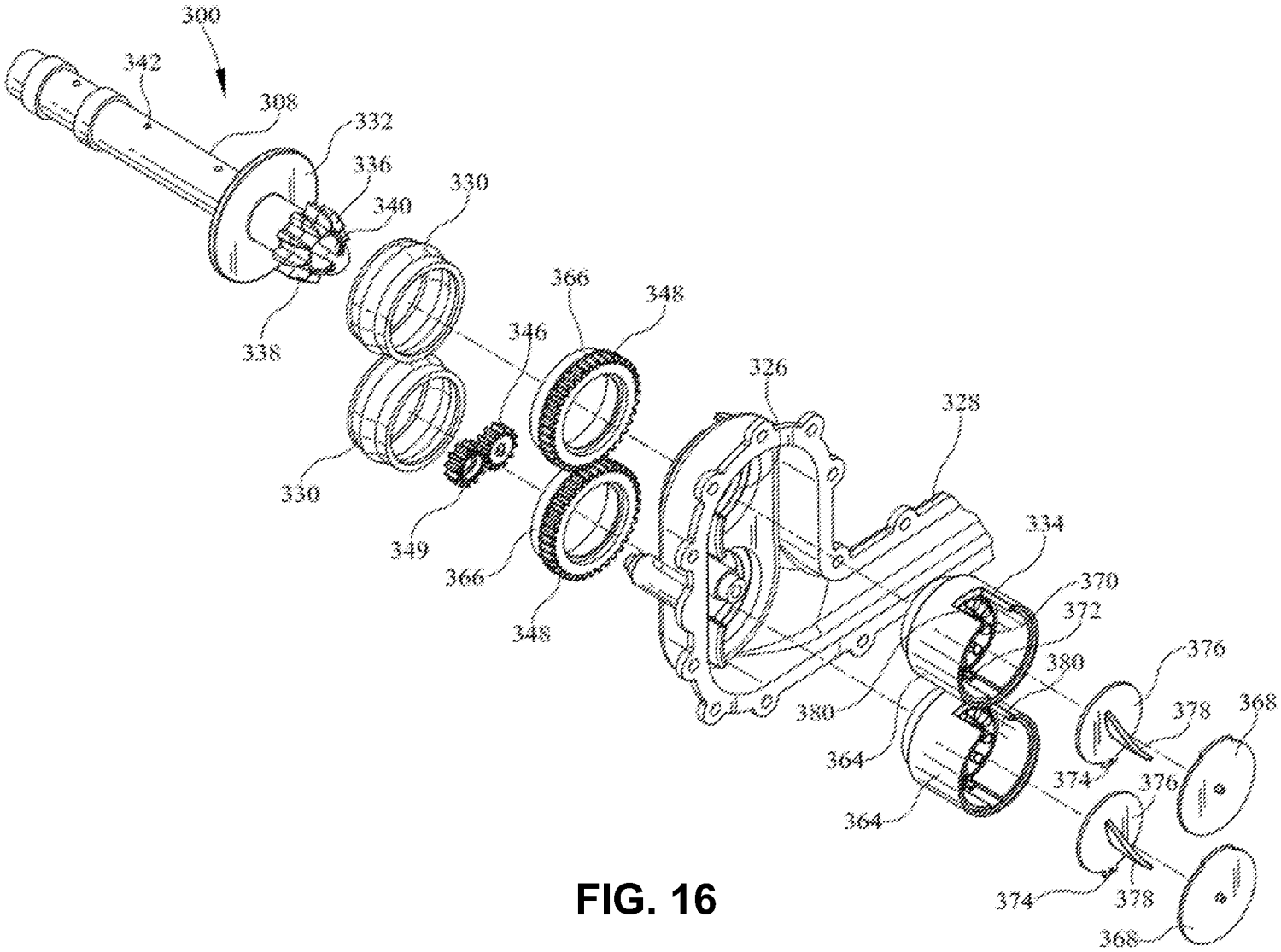
FIG. 16 is a rear exploded perspective view of a portion of the example implementation of FIG. 13.

Each diverter valve 362 additionally includes one or more valve members, e.g., valve members 382 illustrated in FIGS. 15-17, that effectively operate to selectively restrict fluid flow through an inlet 380 when valve body 364 is rotated to a position facing such valve members. In this regard, although the valve members 382 are in fixed positions in the embodiment of FIGS. 15-17, and the valve bodies 364 are rotatable, the sidewall of each valve body circumscribing the inlet effectively operates as a valve seat that is selectively blocked by a fixed position valve member. Each valve member 382 is disposed at a predetermined rotational position (or range of rotational positions) as well as a predetermined radius (or range of radii) such that when valve body 364 is rotated to a position where inlet 380 is directly opposite a valve member, flow through the inlet is restricted or even stopped entirely. In the illustrated embodiment where inlet 380 is a radially-facing inlet, each valve member 382 includes a mating surface that faces the valve body and is generally arcuate in cross-section, with the mating surface extending circumferentially around the valve body at a predetermined radius from the axis of rotation to substantially block flow through the inlet when the inlet is rotated to the predetermined rotational position of the valve member. As such, the predetermined radius for the valve member may be selected to match that of the sidewall of the valve body while still allowing for relative rotation therebetween.

Figure 18:
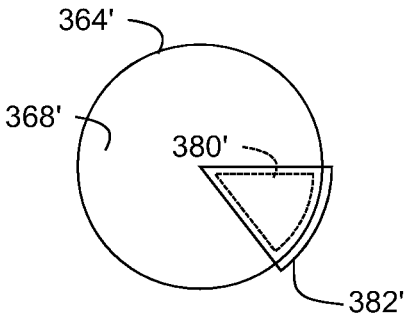
FIG. 18 is a rear elevational view of a valve body and valve member of an alternate implementation of a diverter valve to that illustrated in FIGS. 15-17.

In other embodiments, however, e.g., as illustrated in FIG. 18 where an axially-facing inlet 380' is disposed on a valve body cover 368' of a valve body 364', a valve member 382' may having a mating surface that is planar in nature and extends generally transverse to the rotational axis of the valve body, and that extends along a range of radii and a range of rotational positions.

In some embodiments, valve members 382 may be used to restrict fluid flow in particular directions, e.g., to avoid directing a spray against a tub wall or in other directions that are not useful or are otherwise unused in a wash cycle. In other embodiments, however, valve members 382 may be used to effectively shut off particular tubular spray elements during different portions of a wash cycle. For example, it may be desirable in some embodiments to alternate between different tubular spray elements or other sprayers to increase the fluid pressure and flow to a reduced number of tubular spray elements or sprayers. It may also be desirable in some embodiments to perform more focused spraying in particular regions of a wash tub using one or more tubular spray elements, with other tubular spray elements effectively shut off to increase the pressure and flow rate available to that limited number of tubular spray elements. The selective use of subsets of sprayers may in some embodiments decrease the flow requirements for the dishwasher pump and/or decrease energy consumption in the dishwasher. Put another way, the selective use of subsets of sprayers in some embodiments may maintain a combined output of all of the sprayers in a dishwasher within an output envelope of the fluid supply.

Figure 19:
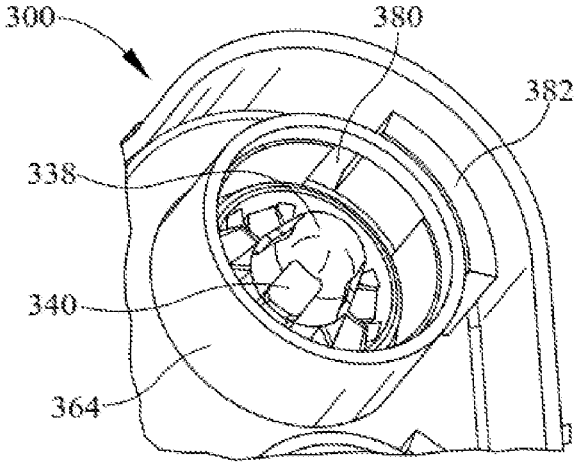
FIG. 19 is a perspective view of a cut-away portion of the example implementation of FIG. 13, illustrating a partially closed diverter valve for regulating fluid flow to a tubular spray element.

In addition, as illustrated in FIG. 19, it may be desirable in some embodiments to rotate a valve body 364 to only partially restrict flow through an inlet 380 by rotating the valve body such that the valve member only partially blocks the fluid inlet. Doing so would regulate flow rate and thereby enable different flow rates to be provided for different tubular spray elements if desired. Furthermore, in some embodiments pump pressure or speed may be varied to vary pump performance based upon whether sprayers are being used concurrently or individually.

Returning to FIG. 15, it will be appreciated that the valve members used for docking ports 318 and 324 may be oriented at rotational positions generally corresponding to the direction of the side wall of the wash tub, such that when the valve body is rotated to those positions fluid flow will stop and fluid will not be directed against the side wall, which could otherwise cause excessive noise in the wash tub. The valve members for docking ports 314 and 320 may be similarly positioned. For docking ports 316 and 322, various positions may be used, e.g., the lower right direction illustrated in FIG. 15, since in operation rotational positions suitable for directing fluid upward into the rack may be considered to be more useful than downward rotational positions in some embodiments. Other positions, sizes and numbers of valve members may be used in different embodiments to provide different ranges of rotational positions in which fluid flow is restricted or allowed for a particular tubular spray element, and valve members may be omitted entirely for some docking ports in some embodiments.

Figure 20:
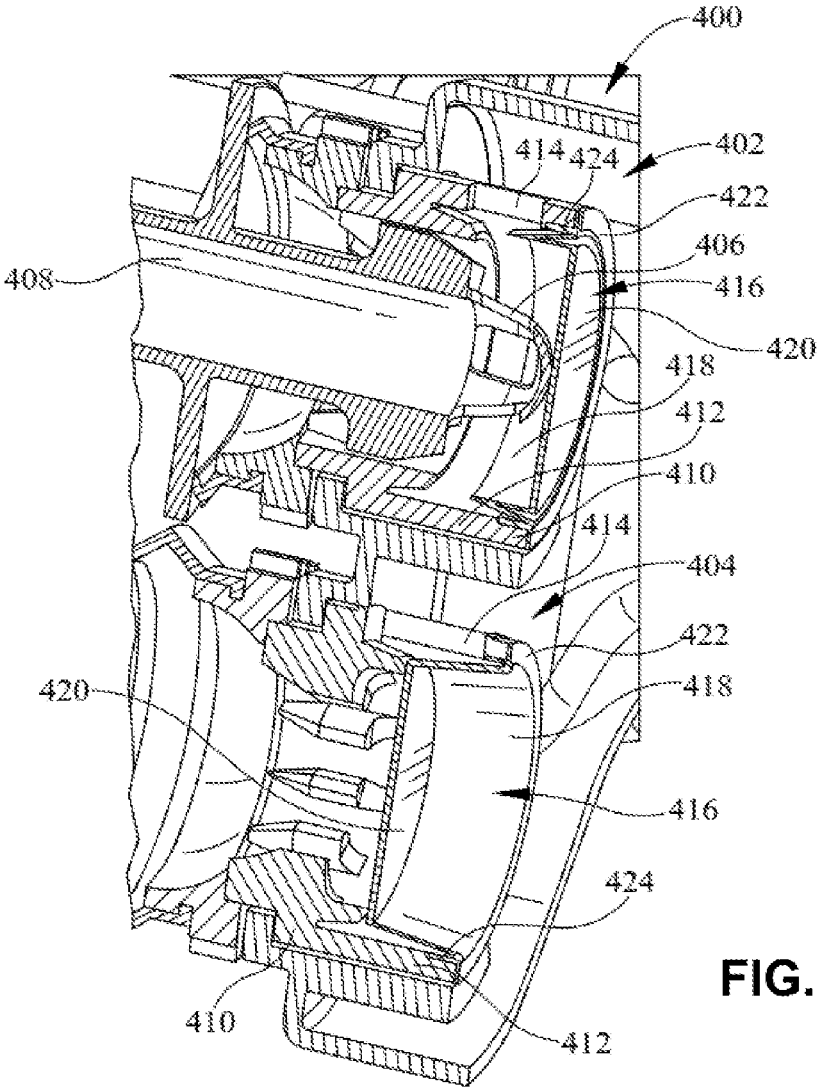
FIG. 20 is a cross-sectional view of an alternate example implementation to the docking arrangement of FIG. 13, and utilizing a cup-shaped check valve.

Now turning to FIG. 20, this figure illustrates a portion of an alternate implementation of a docking arrangement 400 including a pair of upper and lower rotatable docks 402, 404 configured to receive a connector 406 of a tubular spray element 408. A valve body 410 in each rotatable docking port 402, 404 includes a generally cylindrical sidewall 412 having a radially-facing inlet 414. In lieu of a rigid rear cover, however, a cup-shaped check valve 416 is secured to an end surface of the valve body, whereby the check valve rotates with the rotatable dock.

Check valve 416 in some embodiments may be formed of silicone, rubber or another elastomeric material, and may include a flexible sidewall 418 joining an end surface 420 and an annular sealing flange 422. In addition, an annular mounting flange 424 may be disposed proximate to and extend transversely to annular sealing flange 422 to mount check valve 416 to valve body 410 in a press-fit engagement. In some embodiments, it may also be desirable to utilize relatively stiffer materials at least for end surface 420 and/or mounting flange 424, the former for reducing warping of the end surface when displaced by the insertion of connector 406 of tubular spray element 408 into the docking port, and the latter for providing a stronger press-fit engagement between the mounting flange and the valve body. In some embodiments, for example, different durometer materials may be used, while in other embodiments, comolding or overmolding of a low durometer material over a rigid material (e.g., stainless steel) may be used to provide a relatively stiffer end surface and/or mounting flange. In some embodiments, providing a stiffer end surface may prevent blockage of radial flow into the valve body due to deformation of the end surface.

Check valve 416 is configured to move generally axially (i.e., along the axis of rotation of the respective rotatable docking port 402, 404), and is normally biased to the closed position illustrated for lower rotatable docking port 404, whereby sidewall 418 covers the radially-facing inlet 414 of the rotatable dock, thereby restricting fluid flow out of the rotatable dock. However, and as illustrated for upper rotatable docking port 402, when connector 406 of tubular spray element 408 is inserted into the rotatable dock, the connector pushes end surface 420 axially and in a rearward direction, thereby exposing radially-facing inlet 414 and permitting fluid flow through the inlet and the openings 426 in connector 406.

Figure 21:
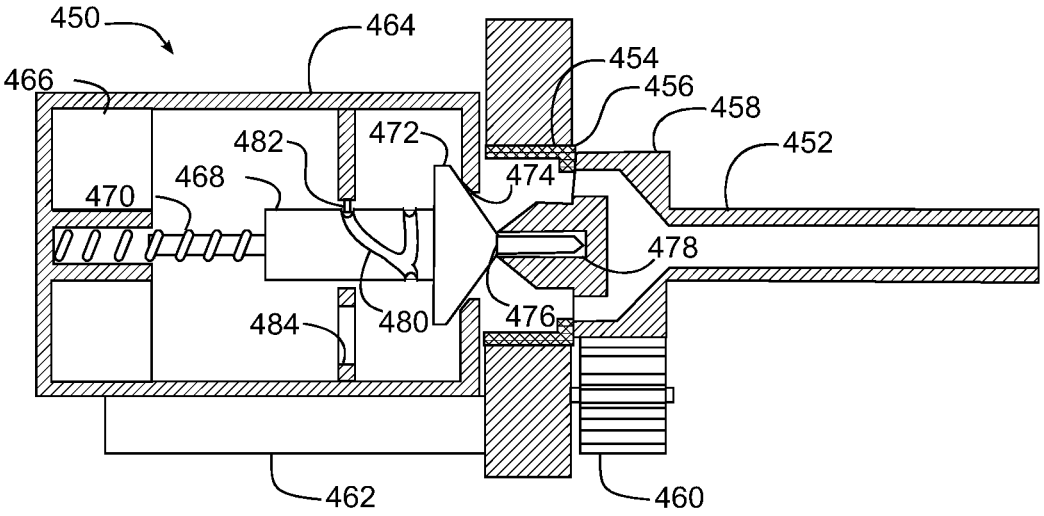
FIGS. 21 and 22 are functional cross-sectional views of an example piston valve suitable for use as a check valve for a docking port consistent with some embodiments of the invention, in open (FIG. 21) and closed (FIG. 22) positions.
Figure 22:
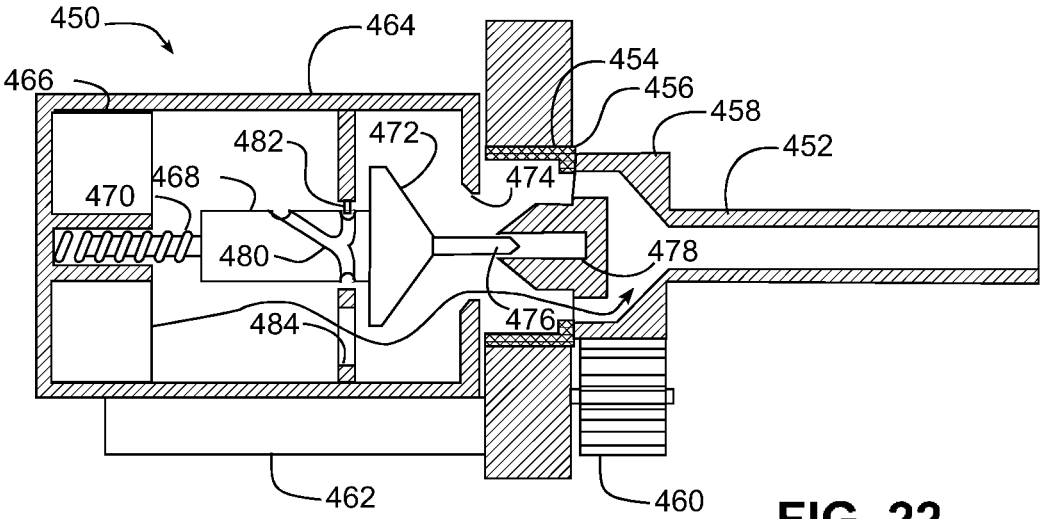
Figure 23:
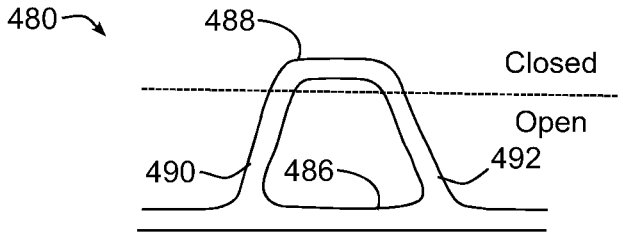
FIG. 23 illustrates an example cam arrangement for the piston valve of FIGS. 21-22.

FIGS. 21-23 illustrate another rotatable docking port 450 suitable for use in some embodiments consistent with the invention. While not illustrated specifically in these figures, it will be appreciated that rotatable docking port 450 may be used in pairs to support multiple rack elevations, and some components, e.g., a stepper motor, may be shared between multiple rotatable docking ports. In other embodiments, any of the valve designs described herein may be used in singles, pairs or other combinations, so the invention is not limited to the specific arrangements described herein.

Docking port 450 may be configured to receive a tubular spray element 452 in a channel 454 and sealed using a gasket 456. A gear 458 is integrated into tubular spray element 452, and gear 458 engages a pinion gear 460 driven by a stepper motor 462. A valve housing 464 includes one or more inlets 466 for receiving fluid, and a rotatable valve body 468 is biased via a spring 470 to a closed position as illustrated in FIG. 21, where a conical valve surface 472 engages a valve seat 474 to restrict fluid flow through channel 454.

Valve body 468 also includes a pin 476 that is received within a recess 478 in tubular spray element 452, and pin 476 and recess 478 are keyed relative to one another to restrict relative rotation between valve body 468 and tubular spray element 452, whereby valve body 468 rotates in connection with rotation of tubular spray element by motor 462 and gears 458, 460.

To control the state of the valve, valve body 468 includes a cam or track 480 within which a pin or guide 482 on an annular support 484 rides to move the valve body axially, i.e., along the axis of rotation of the valve body. It will be appreciated that annular support 484 may include one or more apertures to permit fluid flow from inlet 466 to channel 454 when valve body 468 is in the open or retracted position illustrated in FIG. 22.

FIG. 23 illustrates an example implementation of cam 480 suitable for use in some embodiments. An open track 486 circumscribes valve body 468 at an axial position that maintains the valve in an open position, while a closed track 488 circumscribes valve body 468 over a limited range of rotational positions. A pair of transition legs 490, 492 connect tracks 486, 488, and in part based upon the bias provided by spring 470, transition of valve body 468 between the open and closed positions may be performed through rotation of the valve body by motor 462. Due to the bias, pin 482 (FIGS. 21-22) is retained within track 488 when no tubular spray element is connected to the valve body, whereby the valve is closed. Upon insertion of a tubular spray element and rotation of the valve body by stepper motor 462, the pin may travel along one of legs 490, 492 based upon the direction of rotation, thereby opening the valve in response to rotation of the valve body. Continued rotation in the same direction will cause the pin to engage track 486 and maintain the valve in the open position, at least until reaching the opposite leg 490, 492. Likewise, any counter-rotation of the valve body back toward the leg 490, 492 in which the pin originally traveled when opening the valve will result in travel back along the leg to the closed position. As such, both the rotational position of a tubular spray element, and the open/closed state of the valve may be controlled via stepper motor 462.

It will be appreciated that the placement and configuration of cam 480 may vary in different embodiments based upon the desired range of active and/or inactive rotational positions for an associated tubular spray element, and that different cams may be used for different tubular spray elements based upon their respective placements and/or operational responsibilities in a wash tub. Further, in some embodiments, rather than having a pin on a fixed member and a cam on a rotatable valve body, a cam may be disposed on a fixed member (e.g., on an inner cylindrical wall of a valve housing) and a pin or other guide may be disposed on the rotatable valve body. Therefore, the invention is not limited to the particular cam configuration illustrated in FIGS. 21-23.

Figure 24:
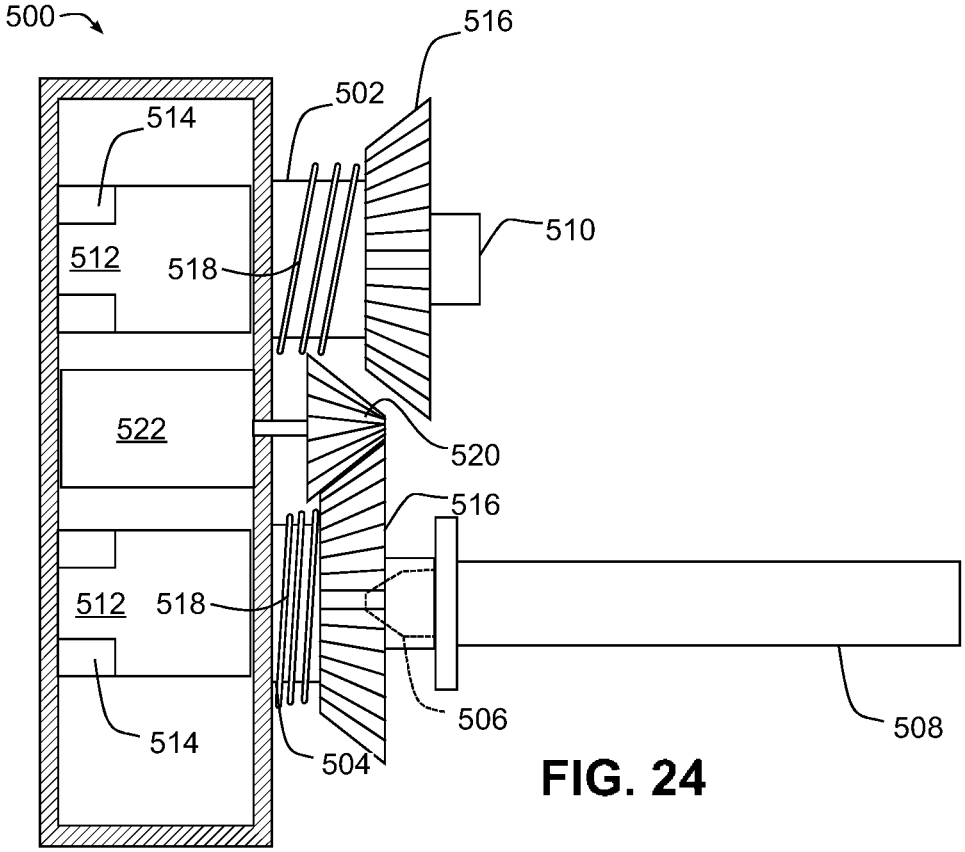
FIG. 24 is a functional cross-sectional view of another alternate example implementation to the docking arrangement of FIG. 13, and utilizing spring-loaded docking ports.

FIG. 24 illustrates yet another example docking arrangement 500 suitable for use in some embodiments of the invention. Docking arrangement 500 includes a pair of upper and lower rotatable docking ports 502, 504 configured to receive a connector 506 of a tubular spray element 508 through a channel 510 thereof. In the illustrated embodiment, channel 510 is keyed such that relative rotation between tubular spray element 508 and rotatable docking port 502, 504 is restricted, i.e., so that both components rotate together.

Each docking port 502, 504 also includes a valve 512 that restricts flow from one or more inlets 514 to the channel 510 of the respective docking port 502, 504. Valve 512 may be actuated in different embodiments via axial, rotational or other movement. For example, valve 512 may be implemented using a flap or cup-shaped check valve as described above in connection with FIGS. 13-20 above, whereby insertion of connector 506 may open the valve. In other embodiments, valve 512 may be implemented similar to that illustrated in FIGS. 21-23, and may selectively opened or closed based upon rotational movement. For example, as illustrated in FIG. 24, valve 512 may be similarly configured to that illustrated in FIGS. 21-23, and may have a valve body that is mechanically coupled to either connector 506 (in a similar manner to valve body 468 of FIGS. 21-22) or to a gear 516 on the rotatable docking port 502, 504 such that the valve body rotates with the tubular spray element and gear 516.

In this embodiment, gear 516 of each rotatable docking port 502, 504 is movable axially along its axis of rotation, and biased via a spring 518 or other biasing member to a forward position that disengages the gear 516 from a pinion gear 520 driven by a stepper motor 522. In this configuration, when no tubular spray element 508 is inserted into a rotatable docking port 502, 504, the gear 516 is disengaged from pinion gear 520 (as shown in FIG. 24 for upper rotatable docking port 502). Likewise, when a tubular spray element 508 is inserted into engagement with a rotatable docking port 502, 504, the gear 516 is pushed rearwardly into engagement with pinion gear 520 (as shown in FIG. 24 for lower rotatable docking port 504). When in this position, rotation of pinion gear 520 by stepper motor 522 controls both rotation of the tubular spray element and actuation of valve 512. As such, rotation of stepper motor 522 only rotates the rotatable docking port 502, 504 in which a tubular spray element 508 has been inserted, and fluid flow is blocked by the respective valve 512 in the rotatable docking port 502, 504 in which no tubular spray element has been inserted.

It will be appreciated by those of ordinary skill having the benefit of the instant disclosure that other valve designs, as well as other valve actuation mechanisms, may be used in connection with tubular spray element docking ports in other embodiments, and therefore, the invention is not limited to the specific implementations discussed herein. Furthermore, it will be appreciated that the various docking ports described herein may be used in groups of three or more to support additional rack elevations, or may be used singularly in connection with a non-adjustable rack.

Furthermore, it will be appreciated that many of the various components discussed herein may be used in connection with rotatable conduits other than the tubular spray elements discussed above. In particular, rotatable docking ports consistent with the invention and/or the various check and/or diverter valves discussed above may be utilized in connection with other types of rack-mounted conduits to support rotation of the conduits along with supplying fluid thereto. A conduit, in this regard, may be considered to include any component including one or more channels for communicating fluid. A conduit may include one or more apertures, nozzles or sprayers in some embodiments, while in other embodiments, a conduit may merely communicate fluid to another component, and itself may have no openings for spraying fluid onto utensils in a wash tub. As one example, a conduit may be mechanically coupled to a separate spray arm or other sprayer mounted in a rack (e.g., via one or more gears) such that rotation of the conduit imparts movement to the attached spray arm or sprayer. In addition, while tubular spray elements are illustrated as being predominantly cylindrical in nature, conduits in other embodiments may have other profiles and shapes, so the invention is not so limited. Moreover, it will be appreciated by those of ordinary skill having the benefit of the instant disclosure that many of the techniques and components discussed herein may be utilized in connection with non-rotatable docking ports and non-rotatable conduits. Additional variations will be appreciated by those of ordinary skill having the benefit of the instant disclosure.

Tubular Spray Element Return Mechanism

Returning briefly to FIG. 13, as discussed above, tubular spray elements and other rotatable conduits may be rotatably supported on a rack using one or more rack mounts, e.g., one or more of rack mounts 312. As illustrated, each rack mount 312 rotatable supports three tubular spray elements, although in other embodiments a rack mount may support greater or fewer numbers of tubular spray elements.

In addition, in the illustrated embodiment, it may be desirable to incorporate into each rack mount 312 a return mechanism that biases a supported tubular spray element or other rotatable conduit to a predetermined rotational position about an axis of rotation of the tubular spray element or other rotatable conduit when it is released from docking arrangement 302, e.g., when the rack is moved from a washing to a loading position. It will be appreciated, for example, that when a tubular spray element is separated from a docking arrangement, e.g., as when the rack is moved from a washing position to a loading position, it may be desirable to ensure that the tubular spray element is maintained at a predetermined or "home" rotational position about its axis of rotation such that when the tubular spray element reengages with a rotatable docking port, the tubular spray element will be at a known rotational position relative to the rotatable docking port. When combined with maintaining a known rotational position of the rotatable docking port, the return mechanism therefore enables the tubular spray element to start at a known and reproducible rotational position when initially engaged with a rotatable docking port such that the spray of fluid from the tubular spray element may be discretely directed as desired.

In some embodiments, for example, a controller may track the rotation of the tubular spray element drive (e.g., using the position sensor of a stepper motor or a separate position sensor) such that when the rack is pushed to the wash position and the tubular spray element connector engages the rotatable docking port, the position of the tubular spray element relative to the rotatable docking port may be determined, thereby enabling the controller to determine the direction in which the tubular spray element is pointing. As another example, a rotatable docking port may be moved to a known "home" position either mechanically (e.g., through a mechanical release once the connector disengages from the docking port) or through rotation of the stepper motor after the connector of the tubular spray element has been disconnected from the docking port, such that when the connector reengages the docking port, a known rotational relationship between the tubular spray element and the home position of the docking port may be used to enable the controller to determine the direction in which the tubular spray element is pointing. In some instances, for example, a Hall effect sensor may be positioned proximate to or otherwise coupled to the rotatable docking port to sense the position of the rotatable docking port.

Figure 25:
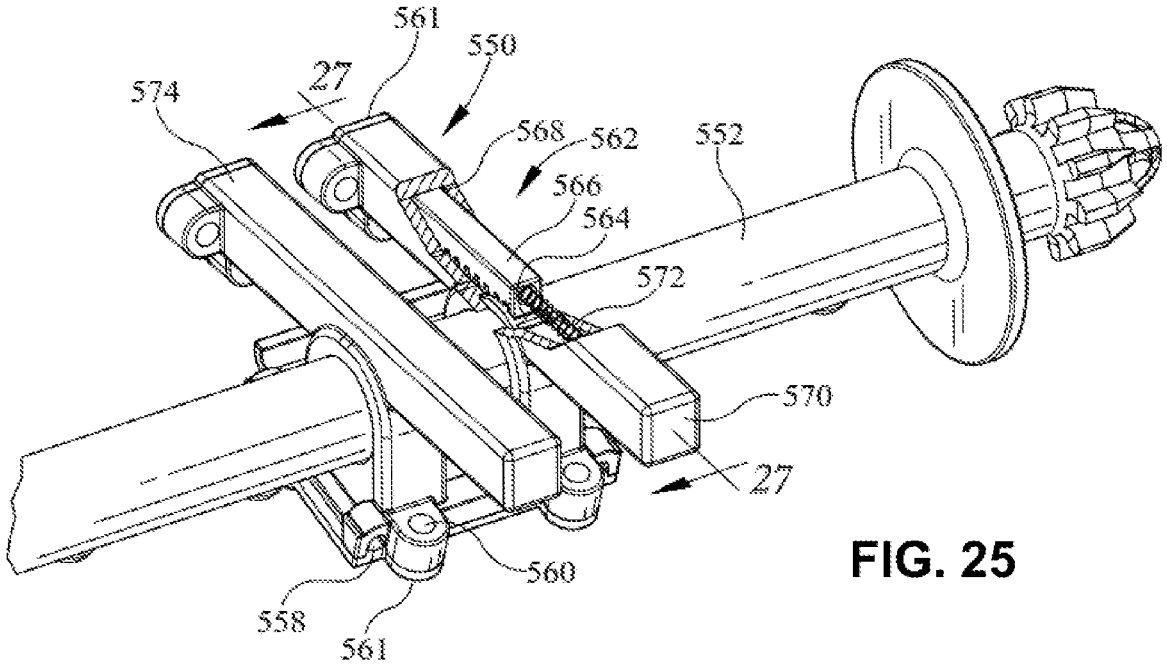
FIG. 25 is a perspective view of an example implementation of a conduit support and tubular spray member, with portions thereof cut away to illustrate a return mechanism utilized therein.
Figure 26:
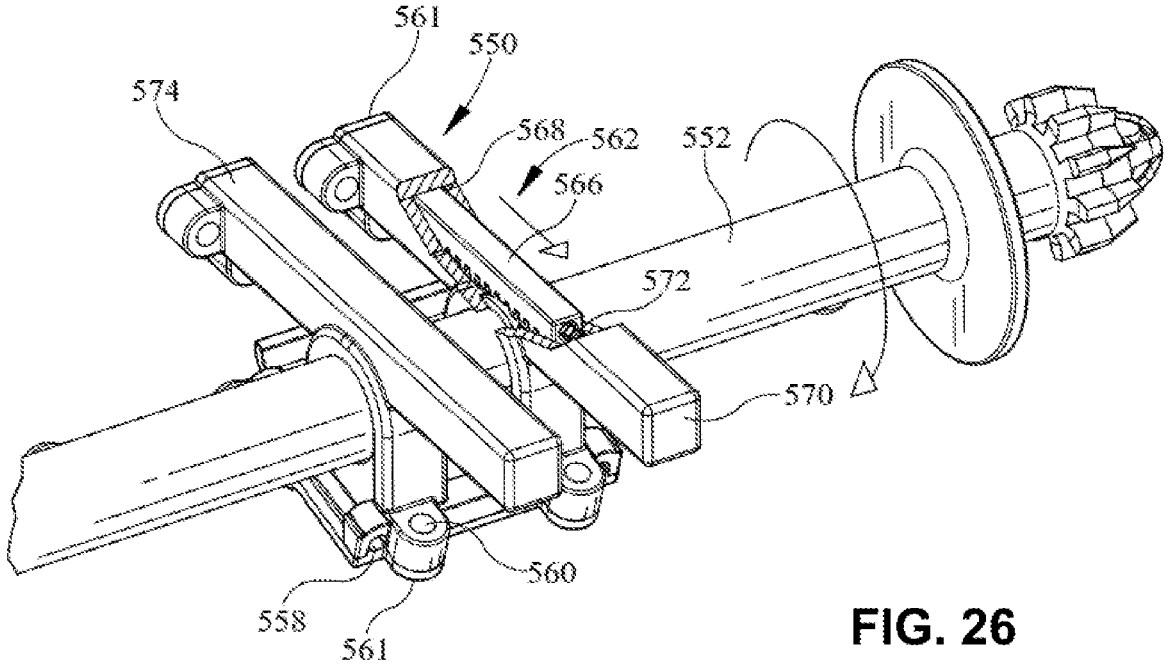
FIG. 26 is a perspective view of the conduit support of FIG. 23, with portions thereof cut away to illustrate a position of the return mechanism in response to rotation of the tubular spray element.

FIGS. 25 and 26 illustrate an example conduit support 550 suitable for supporting a tubular spray element 552, e.g., a side tubular spray element positioned similarly on a rack as tubular spray elements 304 and 308 of FIG. 13. Conduit support 550 includes a pair of bearing surfaces 554, 556 for rotatably supporting tubular spray element 552, and it will be appreciated that various bearings and other rotatable couplings may be used in different embodiments. Conduit support 550 also includes one or more channels 558 for receiving a wire from a rack, as well as one or more threaded apertures 560 for receiving fasteners to secure one or more covers 561 to the support.

In the illustrated embodiment, a return mechanism 562 is implemented in conduit support 550 using a rack-and-pinion arrangement whereby a pinion gear 564 mounted or otherwise formed on a surface of tubular spray element 552 engages with a rack 566 that slides along a channel 568 formed in a leg 570 of conduit support 550. Rack 566 operates as a gear having a linear arrangement of teeth that engage with an annular arrangement of teeth on pinion gear 564 such that rotation of tubular spray element 552 moves rack 566 along a linear path within channel 568.

A biasing member 572, here a coiled compression spring, is mounted within channel 568 to bias rack 566 to the lower end of channel 568. As illustrated in FIG. 26, when tubular spray element 552 is rotated in clockwise direction pinion gear 564 moves rack 566 to the right and towards the opposite end of channel 568, compressing biasing member 572. Thereafter, if the tubular spray element is released from the docking arrangement (e.g., as a result of the rack being moved from the washing to the loading position), biasing member 572 will induce a clockwise rotation of the tubular spray element through rack 566 and pinion gear 564 until rack 566 returns to the end of channel 568 as illustrated in FIG. 25.

Figure 27:
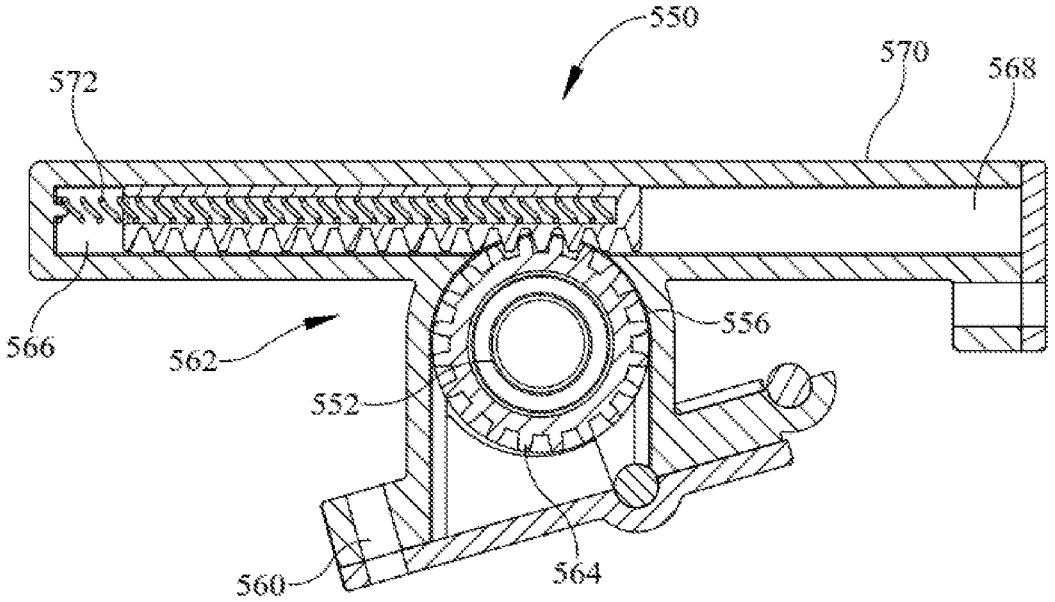
FIG. 27 is an end cross-sectional view of the conduit support of FIG. 23, and illustrating a range of motion thereof.
Figure 28:
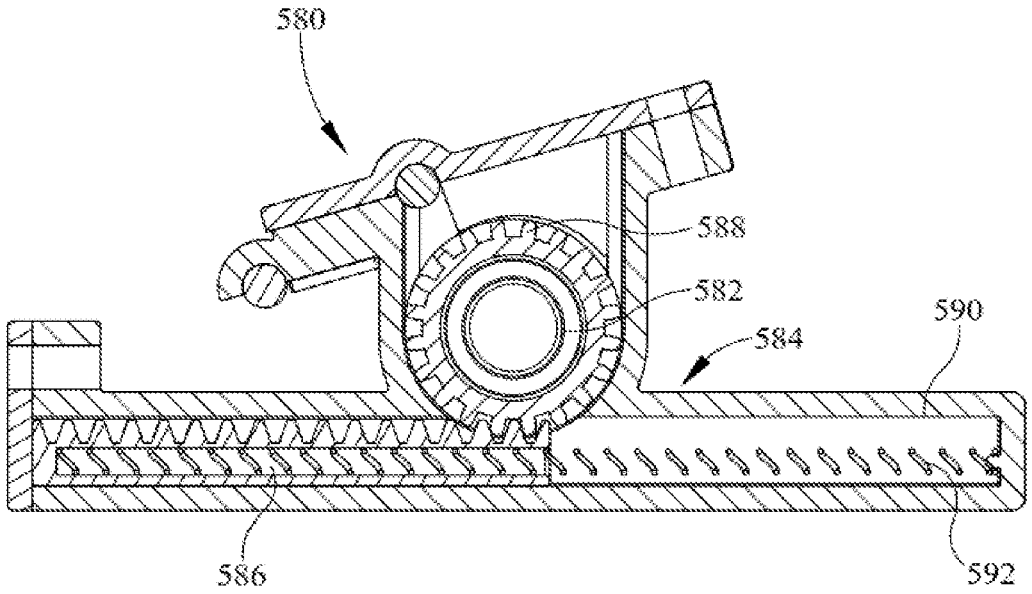
FIG. 28 is an end cross-sectional view of another example implementation of a conduit support suitable for supporting a central tubular spray element, and illustrating a range of motion thereof.

The arrangement of FIGS. 25-26 may be varied in different embodiments to provide both a differing return position and/or range of rotation for a tubular spray element. FIG. 27, for example, illustrates an operative range of motion for tubular spray element 552 to be about 144 degrees. FIG. 28, as an alternative, illustrates a conduit support 580 for a central tubular spray element 582 (positioned, for example, similar to tubular spray element 306 of FIG. 13), and including a return mechanism 584 including a rack 586, pinion gear 588, channel 590 and biasing member 592 similar in configuration to rack 566, pinion gear 564, channel 568 and biasing member 572 of return mechanism 562, but otherwise sized and configured to provide a larger operative range of motion for tubular spray element 582 of about 234 degrees. Further, by installation of a tubular spray element with the pinion gear thereof engaged in a known manner with the rack (e.g., with the spray apertures thereof pointing in a known rotational position), the operative range of motion for the tubular spray element may be precisely controlled.

Returning to FIG. 25, in some embodiments a conduit support such as conduit support 550 may include additional legs, e.g., leg 574, to provide additional support for the tubular spray element. Such legs may also include similar internal channels, and may support the installation of a second return mechanism to engage with an optional second pinion gear formed on the tubular spray element (e.g., if additional return force is desired. The configuration of conduit support 550 may also support its use on the opposite side of the rack such that the same molded parts can be used on both the right and left sides of the rack, whereby a return mechanism would be installed within leg 574 rather than leg 570.

In addition, in some embodiments, multiple conduit supports may be used to support a tubular spray element at multiple points along its axis of rotation (e.g., near the front and rear of the rack), and a return mechanism may be used in each conduit support. In other embodiments, however, no return mechanism may be used in other conduit supports that support the tubular spray element.

Figure 29:
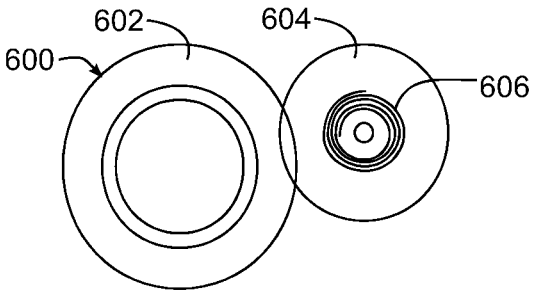
FIG. 29 is a functional end view of another example implementation of a conduit support utilizing a return mechanism including a clock spring biasing member.
Figure 30:
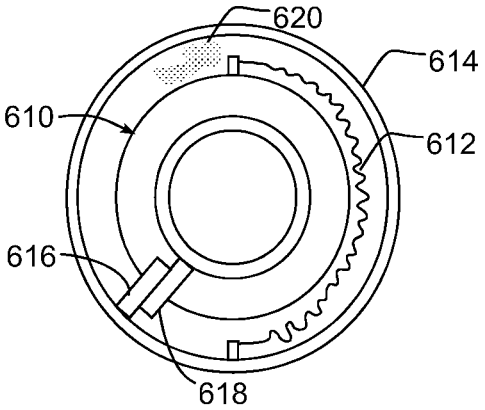
FIG. 30 is a functional end view of yet another example implementation of a conduit support utilizing a return mechanism including an annular biasing member.
Figure 31:
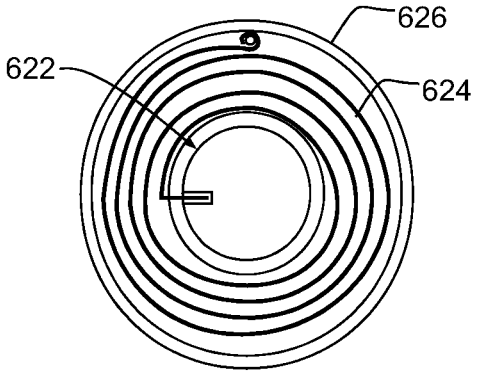
FIG. 31 is a functional end view of yet another example implementation of a conduit support utilizing a return mechanism including a clock spring biasing member.

Other return mechanism configurations may be used in other embodiments consistent with the invention. For example, as illustrated by tubular spray member 600 of FIG. 29, a return mechanism in some embodiments may include a pair of circular gears 602, 604, with gear 602 mounted to tubular spray element 600 and gear 604 including an annular arrangement of teeth and coupled to a biasing member such as a clock spring 606 to provide a biasing force to return the tubular spray element 600 to a home position. As another example, as illustrated by tubular spray element 610 of FIG. 30, an annular biasing member 612, e.g., a spring or elastic band, may be anchored at one end to and wrapped around tubular spray element 610, with the opposite end anchored to a fixed housing 614 to provide the biasing force to return the tubular spray element 610 to a home position. As still another example, and as illustrated by tubular spray element 622 of FIG. 31, a biasing member such as a clock spring 624 may be anchored at one end to and wrapped around tubular spray element 622, with the opposite end anchored to a fixed housing 626 (e.g., as provided on a mount support) to provide the biasing force to return the tubular spray element 622 to a home position.

For each of tubular spray elements 600, 610, 622 it may also be desirable to include a stop member at the home rotational position such that the tubular spray element returns to a repeatable home position (e.g., stop member 616 shown engaging a rib 618 extending along tubular spray element 610). Other manners of imparting a rotational bias to a rotatable body may be used as a return mechanism in other embodiments, as will be appreciated by those of ordinary skill having the benefit of the instant disclosure. Moreover, other biasing arrangements that permit greater than 360 degree rotation, or even unlimited rotation, of a tubular spray element or other rotatable conduit (e.g., using planetary gear arrangements) may also be used, as will be appreciated by those of ordinary skill having the benefit of the instant disclosure. In addition, in some embodiments it may be desirable to use a damper mechanism (e.g., silicone damper paste 620 functionally illustrated in FIG. 30) to limit the rate of rotation when a tubular spray element is disconnected from a docking port.

It will be appreciated that any of the features associated with the return mechanisms illustrated in FIGS. 25-31 may be combined in other manners. As such, return mechanisms consistent with the invention may omit or include any of the various features discussed above.

In still other embodiments, no return mechanisms may be used, and a mechanical coupling between a tubular spray element and a rotatable docking port may be configured to restrict relative rotational movement between the tubular spray element and rotatable docking port only once the rotatable docking port is rotated to a predetermined rotational position relative to the tubular spray element (e.g., such that the tubular spray element and rotatable docking port removably latch together at the predetermined relative rotational position.

Figure 32:
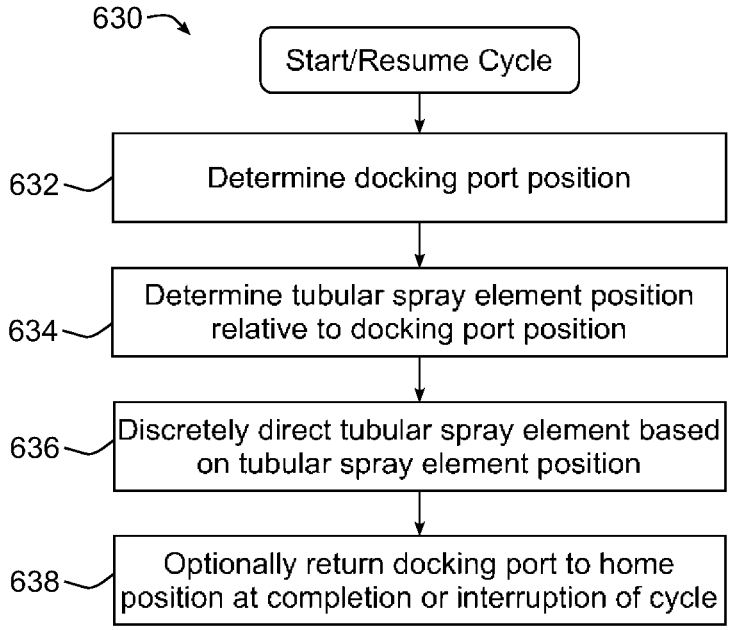
FIG. 32 is a flowchart illustrating an example sequence of operations for discretely directing a tubular spray element during a wash cycle using the dishwasher of FIG. 1.

FIG. 32 next illustrates an example sequence of operations 630, e.g., as may be performed by controller 30 of dishwasher 10, to control a tubular spray element configured with a return mechanism and otherwise as described herein. The sequence may be initiated, for example, at the start of a wash cycle or after a wash cycle is resumed (e.g., after the dishwasher door has been opened or the cycle has been interrupted). In block 632, the position of the rotatable docking port is determined, e.g., using a position sensor or based upon the rotatable docking port having previously been returned to a known "home" position. Next, in block 634, and based upon the fact that it can be assumed that the return mechanism has returned the tubular spray element to a home position prior to reengagement of the tubular spray element with the docking port, or in some instances, based upon detection of the rack having been moved away from the washing position (e.g., using a sensor coupled to the rack, to the docking arrangement, or in other locations that would be apparent to those of ordinary skill having the benefit of the instant disclosure), the position of the tubular spray element relative to the docking port position is determined. Thereafter, in block 636, the wash cycle proceeds, and the tubular spray element is discretely directed to various rotational positions to wash utensils in the dishwasher. Furthermore, at this time, in embodiments where a diverter valve such as described above in connection with FIGS. 13-17 is utilized, the tubular spray element may optionally be effectively deactivated at one or more points during the wash cycle by rotating the tubular spray element to a rotational position corresponding to a closed position of the diverter valve. Then, in block 638, at the conclusion of the wash cycle, or when the cycle is interrupted, the rotatable docking port may optionally be returned to a home position.

Therefore, in some embodiments of the invention, one or more rotatable conduits such as tubular spray elements are supported in a movable dishwasher rack using conduit supports incorporating return mechanisms to return the conduits to predetermined rotational positions, and a docking arrangement incorporating one or more rotatable docking ports is utilized to mechanically and fluidly couple with the conduits to both rotate and supply pressurized air and/or liquid to the conduits. Each docking port may additionally utilize a check and/or diverter valve to selectively control the flow of fluid to a conduit, and moreover, in order to support adjustable dishwasher racks capable of being adjusted to different elevations in a wash tub, sets of rotatable docking ports may be oriented at different elevations to facilitate both mechanical and fluid couplings with a conduit, with unused rotatable docking ports sealed to restrict the flow of fluid therethrough when unused.

It will be appreciated, however, that many of the aforementioned techniques and features may be used separate from other techniques and features disclosed herein, so the invention is not limited to the particular combinations illustrated herein. Docking arrangements, for example, may utilize non-rotatable docking ports in some instances, and moreover, may not incorporate sets of docking ports in embodiments utilizing non-adjustable racks. The various check and/or diverter valve designs described herein may also be used in other applications and other docking arrangements.

Figure 33:
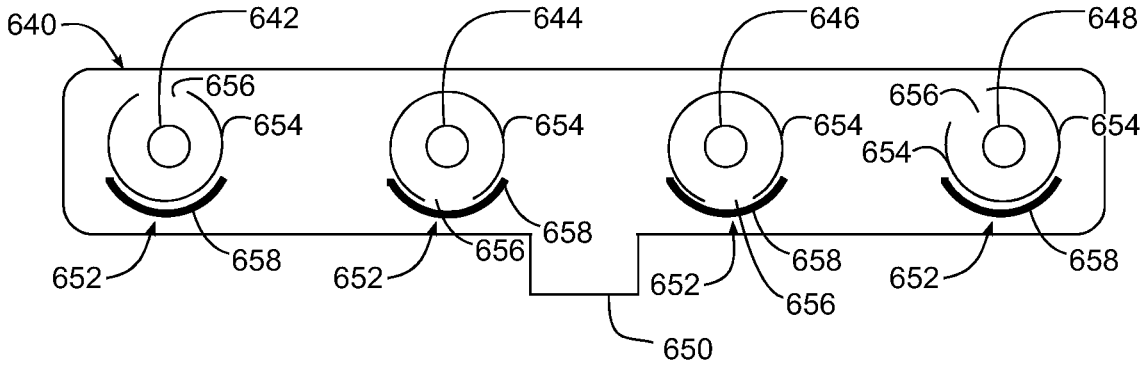
FIG. 33 is a functional end view of an example implementation of a manifold including multiple tubular spray elements and associated diverter valves consistent with some embodiments of the invention.

Further, in some instances the herein-described diverter designs may be used in connection with non-rack-mounted tubular spray elements that are not docked through a docking arrangement, but are instead permanently coupled to a fluid supply within a wash tub. As but one example, and with reference to FIG. 33, in some embodiments a manifold 640 may be used to supply fluid to a plurality of tubular spray elements 642, 644, 646, 648 from an inlet 650. Each tubular spray element 642-648 may include a dedicated diverter valve 652 similar in configuration to diverter valve 362 of FIGS. 13-17, including a rotatable valve body 654 having a fluid inlet 656 and a valve member 658 oriented at a predetermined rotational position about and a predetermined radius from the rotational axis of the tubular spray element to restrict fluid flow to the tubular spray element when the fluid inlet is rotated to the predetermined rotational position (alternatively, a diverter valve similar to that illustrated in FIG. 18 may be used). It will be appreciated that through control of the rotational position of each tubular spray element 642-648, fluid flow to each tubular spray element may be controlled in connection with discretely directing each tubular spray element during a wash cycle, e.g., to sequence between different tubular spray elements such that suitable fluid flow and pressure in the manifold is maintained at all times. FIG. 33, for example, illustrates a scenario where fluid flow to tubular spray elements 644 and 646 is restricted while tubular spray elements 624 and 648 are actively directing sprays of fluid onto utensils in the wash tub.

As such, the combination of diverter valves for tubular spray elements 642-648 may be controlled collectively to effectively provide distributed control over fluid flow and pressure within a dishwasher. It will also be appreciated that the diverter valves may also be used with multiple manifolds and/or with tubular spray elements that are individual supplied with fluid from a fluid supply. The diverter valves may also be used in connection with combinations of both rack-mounted and non-rack-mounted tubular spray elements in other embodiments.

Various additional modifications may be made to the illustrated embodiments consistent with the invention. Therefore, the invention lies in the claims hereinafter appended.

What is claimed is:

1. A dishwasher, comprising:

a wash tub;

a rack supported in the wash tub and movable between loading and washing positions;

a rotatable conduit supported by the rack for movement with the rack, the conduit having a connector for receiving wash fluid; and a docking arrangement coupled to a rear wall of the wash tub and configured to engage with the connector of the conduit when the rack is in the washing position to supply wash fluid to the conduit, the docking arrangement including:

a rotatable docking port positioned to receive the connector of the conduit along an axis of insertion when the rack is moved from the loading position to the washing position, the rotatable docking port being rotatable about an axis of rotation and configured to engage the connector of the conduit such that the conduit rotates with rotation of the rotatable docking port about the axis of rotation; and a check valve coupled to and rotatable with the rotatable docking port, the check valve movable between opened and closed positions and biased to the closed position when the connector of the conduit is disengaged from the rotatable docking port.

2. The dishwasher of claim 1, wherein the check valve is movable generally axially along the axis of insertion from the closed to the opened position in response to engagement of the connector of the conduit with the rotatable docking port.

3. The dishwasher of claim 2, wherein the check valve comprises a cup-shaped diaphragm having a generally cylindrical sidewall, wherein the rotatable docking port includes a radially-facing inlet configured to receive fluid, and wherein the sidewall of the cup-shaped diaphragm blocks the radially-facing inlet when the check valve is in the closed position.

4. The dishwasher of claim 3, wherein the check valve further includes an end surface and an annular sealing flange joined by the generally cylindrical sidewall.

5. The dishwasher of claim 4, wherein the check valve further includes an annular mounting flange extending generally transversely to the annular sealing flange and configured to mount the check valve to a valve body of the rotatable docking port.

6. The dishwasher of claim 5, wherein at least one of the annular mounting flange and the end surface is relatively stiffer than the generally cylindrical sidewall.

7. The dishwasher of claim 6, wherein each of the annular mounting flange and the end surface includes a first material overmolded with a second material, and wherein the first material is relatively stiffer than the second material.

8. The dishwasher of claim 1, wherein the check valve comprises a flap secured along one edge thereof to the rotatable docking port.

9. The dishwasher of claim 8, wherein the check valve includes a biasing member configured to bias the check valve in the closed position.

10. The dishwasher of claim 9, wherein the biasing member comprises a fin extending generally transverse to the flap.

11. The dishwasher of claim 10, wherein the fin is bendable and integrally formed with the flap.

12. The dishwasher of claim 11, wherein the flap and the fin are formed of a bendable material.

13. The dishwasher of claim 1, wherein the rotatable docking port includes a fluid inlet configured to receive fluid, and wherein the dishwasher further comprises a valve member disposed at a predetermined rotational position about the axis of rotation to restrict fluid flow to the conduit when the fluid inlet is rotated to the predetermined rotational position.

14. The dishwasher of claim 13, wherein the fluid inlet is a radially-facing inlet, wherein the rotatable docking port includes a valve body having a cylindrical sidewall, wherein the fluid inlet is disposed in the cylindrical sidewall of the valve body, and wherein the valve member includes a mating surface facing the valve body and being substantially arcuate in cross-section.

15. The dishwasher of claim 1, wherein the rack is adjustable between first and second elevations within the wash tub, wherein the rotatable docking port is a first rotatable docking port positioned to receive the connector of the conduit when the rack is adjusted to the first elevation and disposed in the washing position, and wherein the docking arrangement further includes a second rotatable docking port positioned to receive the connector of the conduit when the rack is adjusted to the second elevation and disposed in the washing position, the second rotatable docking port including a second check valve coupled to and rotatable with the second rotatable docking port, the second check valve movable between opened and closed positions and biased to the closed position when the connector of the conduit is disengaged from the second rotatable docking port.

16. The dishwasher of claim 1, wherein the conduit comprises a tubular spray element being rotatable about a longitudinal axis thereof, wherein the tubular spray element includes one or more apertures extending through an exterior surface thereof, wherein the dishwasher further comprises a tubular spray element drive coupled to the rotatable docking port to rotate the rotatable docking port to discretely direct the tubular spray element to each of a plurality of rotational positions about the longitudinal axis thereof.

17. The dishwasher of claim 16, wherein the tubular spray element drive comprises an electric motor, wherein the electric motor includes a first gear coupled to a drive shaft thereof, and wherein the rotatable docking port includes a second gear that engages the first gear such that rotation of the first gear by the electric motor rotates the rotatable docking port.

18. The dishwasher of claim 16, wherein the tubular spray element is a first tubular spray element, the rotatable docking port is a first rotatable docking port, and the tubular spray element drive is a first tubular spray element drive, wherein the dishwasher further comprises a second tubular spray element rotatably supported by the rack, wherein the docking arrangement comprises a manifold, and wherein the docking arrangement further comprises:

a second rotatable docking port positioned to receive a connector of the second tubular spray element when the rack is moved from the loading position to the washing position, the second rotatable docking port being rotatable about a second axis of rotation, the second rotatable docking port further configured to engage the connector of the second tubular spray element such that the second tubular spray element rotates about the second axis of rotation along with rotation of the second rotatable docking port;

a second tubular spray element drive coupled to the second rotatable docking port to rotate the second rotatable docking port to discretely direct the second tubular spray element to each of a plurality of rotational positions about the longitudinal axis thereof; and a second check valve coupled to and rotatable with the second rotatable docking port, the second check valve movable between opened and closed positions and biased to the closed position when the connector of the second conduit is disengaged from the second rotatable docking port.

19. A dishwasher, comprising:

a wash tub;

a rack supported in the wash tub and movable between loading and washing positions, wherein the rack is adjustable between first and second elevations within the wash tub;

a tubular spray element supported by the rack for movement with the rack, the tubular spray element having a connector for receiving wash fluid;

a docking arrangement coupled to a rear wall of the wash tub and configured to engage with the connector of the tubular spray element when the rack is in the washing position to supply wash fluid to the tubular spray element, the docking arrangement including:

a first rotatable docking port positioned to receive the connector of the tubular spray element when the rack is moved from the loading position to the washing position and the rack is adjusted to the first elevation, the first rotatable docking port being rotatable about a first axis of rotation and configured to engage the connector of the tubular spray element such that the tubular spray element rotates with rotation of the first rotatable docking port about the first axis of rotation when the connector of the tubular spray element is engaged by the first rotatable docking port;

a second rotatable docking port positioned to receive the connector of the tubular spray element when the rack is moved from the loading position to the washing position and the rack is adjusted to the second elevation, the second rotatable docking port being rotatable about a second axis of rotation and configured to engage the connector of the tubular spray element such that the tubular spray element rotates with rotation of the second rotatable docking port about the second axis of rotation when the connector of the tubular spray element is engaged by the second rotatable docking port;

a first check valve coupled to and rotatable with the first rotatable docking port, the first check valve movable between opened and closed positions and biased to the closed position when the connector of the tubular spray element is disengaged from the first rotatable docking port; and a second check valve coupled to and rotatable with the second rotatable docking port, the second check valve movable between opened and closed positions and biased to the closed position when the connector of the tubular spray element is disengaged from the second rotatable docking port; and a tubular spray element drive coupled to the first and second rotatable docking ports and configured to discretely direct the tubular spray element to each of a plurality of rotational positions about the longitudinal axis thereof when the tubular spray element is engaged by one of the first and second rotatable docking ports.

20. The dishwasher of claim 19, wherein the first rotatable docking port includes a first fluid inlet configured to receive fluid, wherein the second rotatable docking port includes a second fluid inlet configured to receive fluid, and wherein the dishwasher further comprises:

a first valve member disposed at a first predetermined rotational position about the first axis of rotation to restrict fluid flow to the tubular spray element when the fluid inlet is rotated to the predetermined rotational position; and a second valve member disposed at a second predetermined rotational position about the second axis of rotation to restrict fluid flow to the tubular spray element when the fluid inlet is rotated to the second predetermined rotational position.

* * * * *